US009994929B2

(12) United States Patent
Fajardo et al.

(10) Patent No.: US 9,994,929 B2
(45) **Date of Patent: *Jun. 12, 2018**

(54) PROCESSES FOR PRODUCING TANTALUM ALLOYS AND NIOBIUM ALLOYS

(71) Applicant: ATI PROPERTIES LLC, Albany, OR (US)

(72) Inventors: Arnel M. Fajardo, Beaverton, OR (US); John W. Foltz, IV, Albany, OR (US)

(73) Assignee: ATI PROPERTIES LLC, Albany, OR (US)

( * ) Notice: Subject to any disclaimer, the term of this patent is extended or adjusted under 35 U.S.C. 154(b) by 313 days.

This patent is subject to a terminal disclaimer.

(21) Appl. No.: 15/043,751

(22) Filed: Feb. 15, 2016

(65) Prior Publication Data

US 2016/0160313 A1 Jun. 9, 2016

Related U.S. Application Data

(63) Continuation-in-part of application No. 13/844,457, filed on Mar. 15, 2013, now Pat. No. 9,260,765.

(51) Int. Cl.

| | |
|---|---|
| ***C22B 34/24*** | (2006.01) |
| ***C22B 4/04*** | (2006.01) |
| ***C22C 27/02*** | (2006.01) |
| ***C22C 1/02*** | (2006.01) |
| ***B22F 3/23*** | (2006.01) |
| ***B22F 3/24*** | (2006.01) |
| ***C22C 1/04*** | (2006.01) |
| ***C22B 5/04*** | (2006.01) |
| ***C22B 9/22*** | (2006.01) |

(52) U.S. Cl.

CPC ..... *C22B 4/04* (2013.01); *B22F 3/23* (2013.01); *B22F 3/24* (2013.01); *C22B 5/04* (2013.01); *C22B 9/228* (2013.01); *C22B 34/24* (2013.01); *C22C 1/02* (2013.01); *C22C 1/045* (2013.01); *C22C 27/02* (2013.01); *B22F 2998/10* (2013.01); *B22F 2999/00* (2013.01)

(58) Field of Classification Search

CPC ..... C22B 4/04; B22F 3/23; B22F 3/24

See application file for complete search history.

(56) References Cited

U.S. PATENT DOCUMENTS

| | | | |
|---|---|---|---|
| 3,184,302 | A | 5/1965 | Chindgren |
| 3,597,192 | A | 8/1971 | Wilhelm et al. |

(Continued)

FOREIGN PATENT DOCUMENTS

| | | | |
|---|---|---|---|
| CA | 620031 | A | 5/1961 |
| CN | 1629343 | A | 6/2005 |

(Continued)

OTHER PUBLICATIONS

Zelikman A. N. et al., Niobium and Tantalum, Moscow: Metallurgiya Publishers, 1990 p. 125.

(Continued)

*Primary Examiner* — Scott Kastler

(74) *Attorney, Agent, or Firm* — K&L Gates LLP

(57) ABSTRACT

Processes for the production of tantalum alloys and niobium are disclosed. The processes use aluminothermic reactions to reduce tantalum pentoxide to tantalum metal or niobium pentoxide to niobium metal.

23 Claims, 7 Drawing Sheets

(56) References Cited

U.S. PATENT DOCUMENTS

| | | | | |
|---|---|---|---|---|
| 7,354,472 | B2 | 4/2008 | Shekhter et al. | |
| 7,399,335 | B2 | 7/2008 | Shekhter et al. | |
| 9,260,765 | B2 * | 2/2016 | Fajardo | B22F 3/23 |
| 2003/0070509 | A1 * | 4/2003 | Osako | B22F 9/18 75/343 |
| 2009/0214378 | A1 * | 8/2009 | Haas | B22F 9/22 420/427 |

FOREIGN PATENT DOCUMENTS

| | | | |
|---|---|---|---|
| CN | 1995420 | | 7/2007 |
| CN | 101879603 | A | 11/2010 |
| GB | 985253 | A | 3/1965 |
| JP | S47-22313 | A | 10/1992 |
| RU | 2257421 | C1 | 7/2005 |
| RU | 2302928 | C2 | 7/2007 |
| WO | WO 99/81672 | A1 | 12/1999 |
| WO | WO 02/090024 | A1 | 11/2002 |
| WO | WO 2014/143553 | A1 | 9/2014 |

OTHER PUBLICATIONS

Nunes et al., "Nb—Ta alloys by aluminothermic reduction of Nb205/Ta205 mixtures and electron beam melting", International Journal of Refractory Metals & Hard Materials, 17, 1999, pp. 305-314.

Carlson, O.N., "Reduction of Oxides by Metals", Jan. 1, 1973, pp. 189-206.

de Brito et al., "Production of tantalum by aluminothermic reduction in plasma reactor", International Journal of Refractory Metals & Hard Materials, 26, 2008, pp. 433-437.

ASM International, "Aluminum-Tantalum Binary Alloy Phase Diagram," ASM Handbook, 1992.

ASM International, "Iron-Tantalum Binary Alloy Phase Diagram," ASM Handbook, 1992.

Kamat et al., "Open Aluminothermic Reduction of Columbium (Nb) Pentoxide and Purification of the Reduced Metal," Metallurgical Transactions, vol. 2, Oct. 1971.

Kimura et al., "Phase Relations Relevant to Hexagonal Barium Aluminates," Material Research Bulletin, vol. 17, 1982.

Moffat, "Copper-Tantalum Binary Phase Diagram," The Handbook of Binary Phase Diagrams, Dec. 1996.

Nair et al., "Production of Tantalum Metal by the Aluminothermic Reduction of Tantalum Pentoxide," Journal of Less-Common Metals, vol. 41, 1975.

Nunes et al., "Nb—Ta Alloys by Aluminothermic Reduction of Nb2O5/Ta2O5 Mixture and Electron Beam Melting," in Tantalum, Chen et al., eds., The Minerals, Metals & Materials Society, 1996.

Purushotham et al, "Quality improvements in tantalum powder by automation of sodium reduction system," International Journal of Refractory Metals & Hard Materials, vol. 27, 2009.

Sharma et al., "Aluminothermic preparation of Hf—Ta and Nb—10Hf—1Ti alloys and their characterization," Journal of Alloys and Compounds, vol. 350, 2003.

Subramanian et al., "The Cu—Ta (Copper-Tantalum) System," Bulletin of alloy Phase Diagrams, vol. 10, No. 6, 1989.

Toru et al., "Metallothermic reduction as an electronically mediated reaction," Journal of Materials Research, vol. 13, No. 12, Dec. 1998.

Yuan et al., "Production of Fine Tantalum Powder by Electrochemical Method," Materials Transactions, vol. 48. No. 10, 2007.

* cited by examiner

PROCESSES FOR PRODUCING TANTALUM ALLOYS AND NIOBIUM ALLOYS

CROSS-REFERENCE TO RELATED APPLICATIONS

This patent application is a continuation-in-part application and claims the benefit of the filing date under 35 U.S.C. § 120 of co-pending U.S. patent application Ser. No. 13/844,457, filed on Mar. 15, 2013, which issued on Feb. 16, 2016 as U.S. Pat. No. 9,260,765. U.S. patent application Ser. No. 13/844,457 is incorporated by reference into this specification.

TECHNICAL FIELD

This specification relates to processes for the production of tantalum alloys and niobium alloys. This specification also relates to tantalum alloy and niobium alloy mill products and intermediates made using the processes described in this specification.

BACKGROUND

Tantalum is a hard, ductile, acid-resistant, and highly conductive metal with a density of 16.65 g/cm$^3$. Tantalum has a high melting point temperature of 3020° C. Tantalum is often used as an alloy additive and is frequently combined with niobium to increase niobium's corrosion resistance properties. When mixed with metals such as niobium, tantalum has excellent resistance to a wide variety of corrosive environments, including mineral acids, most organic acids, liquid metals, and most salts.

Niobium has physical and chemical properties similar to tantalum, including similar hardness, ductility, acid-resistance, and conductivity, although niobium is less dense (8.57 g/cm$^3$) than tantalum (16.65 g/cm$^3$). Niobium has a melting point temperature of 2477° C. As noted above, niobium and tantalum can be alloyed together or with other elements to make niobium-base or tantalum-base alloys. Niobium and tantalum alloys have properties suitable for a variety of applications, for example, in the aerospace, chemical processing, medical, superconducting, and electronics markets, among others.

SUMMARY

In a non-limiting embodiment, a process for the production of tantalum alloys comprises conducting an aluminothermic reaction to reduce tantalum pentoxide powder to tantalum metal.

In another non-limiting embodiment, a process for the production of niobium alloys comprises conducting an aluminothermic reaction to reduce niobium pentoxide powder to niobium metal.

In another non-limiting embodiment, a process for the production of a tantalum alloy comprises conducting aluminothermic reactions using a reactant mixture comprising: tantalum pentoxide powder; at least one of iron (III) oxide powder and copper (II) oxide powder; barium peroxide powder; and aluminum metal powder.

In another non-limiting embodiment, a process for the production of a tantalum alloy or a niobium alloy comprises conducting aluminothermic reactions using a reactant mixture comprising: tantalum pentoxide powder and/or niobium pentoxide powder; iron (III) oxide powder and/or copper (II) oxide powder; barium peroxide powder; aluminum metal powder; and at least one of tungsten trioxide powder, molybdenum trioxide powder, chromium (III) oxide powder, hafnium dioxide powder, zirconium dioxide powder, titanium dioxide powder, vanadium pentoxide powder, and tungsten metal powder.

In another non-limiting embodiment, a process for the production of a niobium alloy comprises conducting aluminothermic reactions using a reactant mixture comprising: niobium pentoxide powder; iron (III) oxide powder and/or copper (II) oxide powder; barium peroxide powder; aluminum metal powder; and at least one of tantalum pentoxide powder, tungsten trioxide powder, molybdenum trioxide powder, chromium (III) oxide powder, hafnium dioxide powder, zirconium dioxide powder, titanium dioxide powder, vanadium pentoxide powder, and tungsten metal powder.

In another non-limiting embodiment, a process for the production of a tantalum alloy comprises conducting aluminothermic reactions using a reactant mixture comprising: tantalum pentoxide powder; at least one of iron (III) oxide powder and copper (II) oxide powder; barium peroxide powder; aluminum metal powder; and at least one of niobium pentoxide powder, tungsten metal powder, and tungsten trioxide powder.

In another non-limiting embodiment, a process for the production of a tantalum alloy comprises positioning a reactant mixture in a reaction vessel. The reactant mixture comprises: tantalum pentoxide powder; at least one of iron (III) oxide powder and copper (II) oxide powder; barium peroxide powder; aluminum metal powder; and at least one of niobium pentoxide powder, tungsten metal powder, and tungsten trioxide powder. Aluminothermic reactions are initiated between the reactant mixture components.

In another non-limiting embodiment, a process for the production of a tantalum alloy comprises forming a reactant mixture comprising tantalum pentoxide powder, iron (III) oxide powder, copper (II) oxide powder, barium peroxide powder, aluminum metal powder, and tungsten metal powder. A magnesium oxide powder layer is positioned on at least the bottom surface of a graphite reaction vessel. The reactant mixture is positioned in the graphite reaction vessel on top of the magnesium oxide powder layer. A tantalum or tantalum alloy ignition wire is positioned in contact with the reactant mixture. The reaction vessel is sealed inside a reaction chamber. A vacuum is established inside the reaction chamber. The ignition wire is energized to initiate aluminothermic reactions between the reactant mixture components. The aluminothermic reactions produce reaction products comprising a monolithic and fully-consolidated alloy regulus and a separate slag phase. The alloy regulus comprises tantalum and tungsten. The slag phase comprises aluminum oxide and barium oxide. The reaction products are cooled to ambient temperature. The reaction products are removed from the reaction vessel. The slag and the regulus are separated.

It is understood that the invention disclosed and described in this specification is not limited to the embodiments summarized in this Summary.

BRIEF DESCRIPTION OF THE DRAWINGS

Various features and characteristics of the non-limiting and non-exhaustive embodiments disclosed and described in this specification may be better understood by reference to the accompanying figures, in which.

Figure 1A:
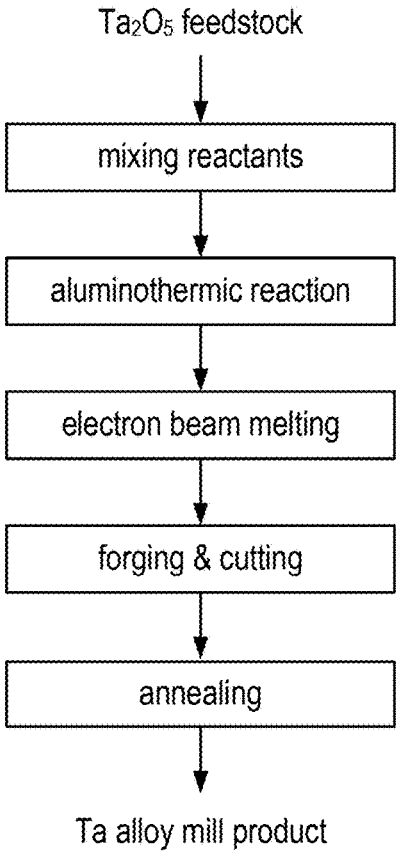
FIG. 1A is a flow diagram illustrating the flow of a process for the production of tantalum alloy mill products from a tantalum pentoxide feedstock.

The reader will appreciate the foregoing details, as well as others, upon considering the following detailed description of various non-limiting and non-exhaustive embodiments according to this specification.

DESCRIPTION

Various embodiments are described and illustrated in this specification to provide an overall understanding of the function, operation, and implementation of the disclosed processes for the production of tantalum alloys. It is understood that the various embodiments described and illustrated in this specification are non-limiting and non-exhaustive. Thus, the invention is not necessarily limited by the description of the various non-limiting and non-exhaustive embodiments disclosed in this specification. The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, Applicant reserves the right to amend the claims to affirmatively disclaim features or characteristics that may be present in the prior art. Therefore, any such amendments comply with the requirements of 35 U.S.C. § § 112(a) and 132(a). The various embodiments disclosed and described in this specification can comprise, consist of, or consist essentially of the features and characteristics as variously described herein.

Also, any numerical range recited in this specification is intended to include all sub-ranges of the same numerical precision subsumed within the recited range. For example, a range of "1.0 to 10.0" is intended to include all sub-ranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited in this specification is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such sub-ranges would comply with the requirements of 35 U.S.C. § § 112(a) and 132(a).

Any patent, publication, or other disclosure material identified herein is incorporated by reference into this specification in its entirety unless otherwise indicated, but only to the extent that the incorporated material does not conflict with existing descriptions, definitions, statements, or other disclosure material expressly set forth in this specification. As such, and to the extent necessary, the express disclosure as set forth in this specification supersedes any conflicting material incorporated by reference herein. Any material, or portion thereof, that is said to be incorporated by reference into this specification, but which conflicts with existing definitions, statements, or other disclosure material set forth herein, is only incorporated to the extent that no conflict arises between that incorporated material and the existing disclosure material. Applicants reserve the right to amend this specification to expressly recite any subject matter, or portion thereof, incorporated by reference herein.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

The metals tantalum and niobium may be initially obtained from tantalum-containing and niobium-containing mineral ores such as, for example, tantalite and niobite (columbite): (Fe, Mn) (Ta, Nb)$_2$O$_6$. Generally speaking, when these mineral ores contain more tantalum than niobium, the ores are referred to as tantalite, and when the mineral ores contain more niobium than tantalum, the ores are referred to as niobite or columbite. These mineral ores may be mined and processed by crushing, gravity separation, and treatment with hydrofluoric acid (HF) to produce complex metal-fluorides such as $H_2(TaF_7)$ and $H_2(NbOF_5)$. The tantalum-fluorides and the niobium-fluorides may be separated from each other through liquid-liquid extractions using water and organic solvents such as cyclohexanone. The separated metal-fluorides may be further processed to produce industrial feedstocks.

The tantalum-fluorides, for example, may be treated with potassium fluoride salt to precipitate potassium heptafluorotantalate:

$$H_2(TaF_7)_{(aq)}+2\ KF_{(aq)} \rightarrow K_2(TaF_7)_{(s)}+2\ HF_{(aq)}$$

The potassium heptafluorotantalate precipitate may be collected and reduced with molten sodium to produce refined and purified tantalum metal:

$$K_2(TaF_7)_{(l)}+5\ Na_{(l)} \rightarrow Ta_{(s)}+5\ NaF_{(l)}+2\ KF_{(l)}$$

Alternatively, the tantalum-fluorides may be treated with ammonia to precipitate tantalum pentoxide:

$$2\ H_2(TaF_7)_{(aq)}+14\ NH_4OH_{(aq)} \rightarrow Ta_2O_{5\ (s)}+14\ NH_4F_{(aq)}+9\ H_2O$$

The production of tantalum pentoxide using ammonia is less expensive than the sodium reduction process and, therefore, tantalum pentoxide is a less expensive commodity chemical than virgin sodium-reduced tantalum metal.

Similarly, the niobium-fluorides, for example, may be treated with potassium fluoride salt to precipitate potassium oxypentafluoroniobate, which may be collected and reduced with sodium, hydrogen, or carbon to produce refined and purified niobium metal. Alternatively, the niobium-fluorides may be treated with ammonia to precipitate niobium pentoxide:

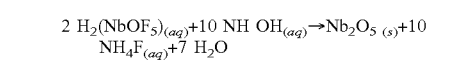

$$2\ H_2(NbOF_5)_{(aq)}+10\ NH\ OH_{(aq)} \rightarrow Nb_2O_{5\ (s)}+10\ NH_4F_{(aq)}+7\ H_2O$$

The production of niobium pentoxide using ammonia, like the production of tantalum pentoxide using ammonia, is less expensive than the sodium, hydrogen, or carbon reduction process and, therefore, niobium pentoxide is a less expensive commodity chemical than virgin reduced niobium metal The refined and purified tantalum and niobium metals produced through reduction processes are primarily used for the commercial production of electronic components such as capacitors and high-power resistors. Accordingly, the cost of virgin reduced tantalum and niobium metal as an industrial feedstock is relatively high, driven by the demand from the electronics industry and the costs associated with the reduction processes. This high cost may pose issues for producers of tantalum and niobium alloys and mill products. The producers of tantalum and niobium alloys and mill products do not necessarily require input materials with the level of refinement and purity achieved by the reduction processes. Furthermore, the alloying of tantalum and niobium with other metals requires costly powder processing to produce a compact suitable for electron-beam melting to homogenize and refine the alloy chemistry.

Tantalum and niobium have a high melting point temperature compared with most metals. Therefore, alloying of tantalum and niobium with each other, and/or with other elements such as tungsten, molybdenum, zirconium, titanium, hafnium, or vanadium, for example, which also have relatively high melting point temperatures, usually requires the use of an electron beam furnace to melt a compact comprising a hot pressed and sintered mixture of tantalum powder and alloying element powder. Tantalum and niobium are also relatively ductile. Therefore, unalloyed tantalum or niobium scrap or virgin metal produced through reduction processes, for example, usually must be embrittled by a hydriding treatment before the tantalum or niobium can be crushed into a powder form. The hydrided tantalum powder or niobium powder usually also must be dehydrided before the hot pressing and sintering with other alloying element powders to produce the input compact for an electron beam melting furnace. This hydriding-dehydriding (HDH) process, which requires significant capital and operational infrastructure including a hydriding furnace, a crusher, a compactor, a vacuum furnace, and pressing/sintering equipment, adds significant additional costs to the alloying of tantalum and niobium over the already high costs of virgin reduced tantalum metal or niobium metal input material.

The downstream electron beam melting of pressed and sintered powder compacts comprising tantalum, niobium, and/or other alloying elements may involve additional issues. On a macroscopic scale, the tantalum and niobium powders and other alloying element powders are homogeneously blended before pressing and sintering. However, the resulting compacts do not comprise a homogeneous solid state solution comprising alloying elements completely dissolved in a tantalum matrix or niobium matrix. Instead, the compacts comprise discrete and isolated regions or inclusions of alloying elements such as, for example, tungsten, molybdenum, zirconium, titanium, hafnium, or vanadium, distributed in a relatively continuous region or phase of tantalum metal. The discrete alloying element regions and tantalum regions or niobium regions of this multi-phase microstructure correspond to the respective powder particles that are metallurgically bonded together to form the compact.

The electron beam melting of the compact is intended to homogenize and refine the alloy composition and produce an ingot having a uniform microstructure, reduced levels of relatively volatile tramp elements, and specified alloying elements completely dissolved and uniformly distributed as a solid state solution in a tantalum matrix or niobium matrix. In practice, however, the liquid phase mixing of high-melting point materials, such as, for example, tantalum, niobium, tungsten, molybdenum, zirconium, titanium, hafnium, or vanadium, may be difficult to achieve with electron beam melting. For instance, the relatively small melt pool and the lack of superheat in the melt pool may impede thorough liquid phase mixing. Moreover, the dripping of molten material from the compact into the melt pool in electron beam melting furnaces may lessen the dispersion of the alloy constituents. Current industrial scale electron beam melting furnaces also lack the capability to induce supplementary physical agitation of the melt pool, which would improve alloy dispersion and homogenization of the alloy constituents.

Figure 1B:
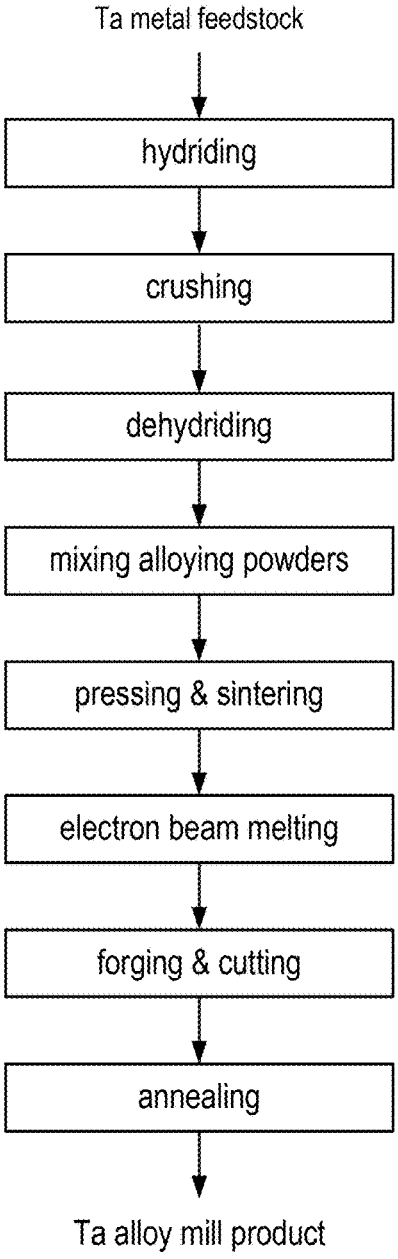
FIG. 1B is a flow diagram illustrating the flow of a process for the production of tantalum alloy mill products from a tantalum metal feedstock.

The processes described in this specification are directed to the production of tantalum base alloys or niobium base alloys and mill products from a tantalum pentoxide or niobium pentoxide feedstock, as opposed the production of tantalum base alloys or niobium base alloys and mill products from a virgin reduced or scrap tantalum metal or niobium metal feedstock. In various embodiments, a process for the production of tantalum alloys or niobium alloys may comprise conducting an aluminothermic reaction to reduce tantalum pentoxide powder to tantalum metal or to reduce niobium pentoxide powder to niobium metal. FIGS. 1A and 1B are flow diagrams illustrating the operational infrastructure savings provided by the aluminothermic reaction processes described in this specification (FIG. 1A) as compared to processes using tantalum metal feedstocks for the production of tantalum alloy mill products (FIG. 1B). An analogous comparison can be made between the aluminothermic production and powder metallurgical production of niobium alloy mill products.

The aluminothermic reaction processes described in this specification eliminate: (1) the need for relatively costly virgin reduced tantalum metal or niobium metal; (2) the costly HDH process; and (3) the pressing and sintering operations needed to produce a powder compact for electron beam melting. The processes described in this specification directly produce a consolidated tantalum alloy regulus or niobium alloy regulus that may be directly input into an electron beam melting furnace for refinement of the tantalum alloy or niobium alloy composition. The tantalum alloy or niobium alloy reguli produced according to the aluminothermic reaction processes described in this specification also comprise alloying elements completely dissolved into the tantalum matrix or niobium matrix, which facilitates the direct electron beam melting and casting of tantalum alloy or niobium alloy ingots having a uniform microstructure and alloying elements completely and uniformly distributed in the tantalum matrix or niobium matrix.

As used in this specification, the term "aluminothermic reaction(s)" refers to high temperature exothermic oxidation-reduction chemical reactions between aluminum metal (functioning as a reducing agent) and metal peroxide and/or metal oxides (functioning as oxidizing agents). Aluminothermic reactions produce an aluminum oxide ($Al_2O_3$)-based slag and reduced metal values. As used in this specification, the term "regulus" (and its plural form, "reguli") refer to the consolidated and solidified metal or alloy portion of the reaction products of aluminothermic reactions.

Figure 2A:
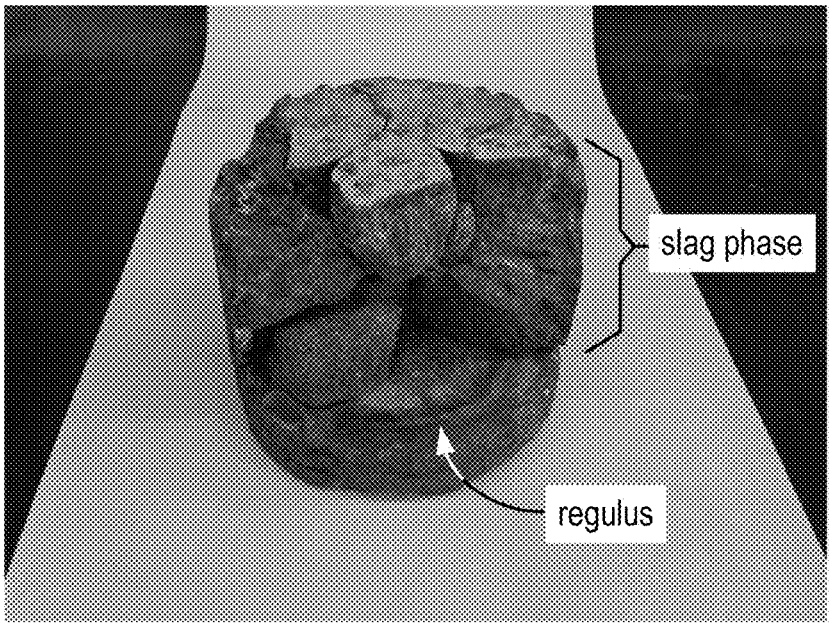
FIG. 2A is a photograph of aluminothermic reaction products comprising a well-defined and separated regulus and slag phase.
Figure 2B:
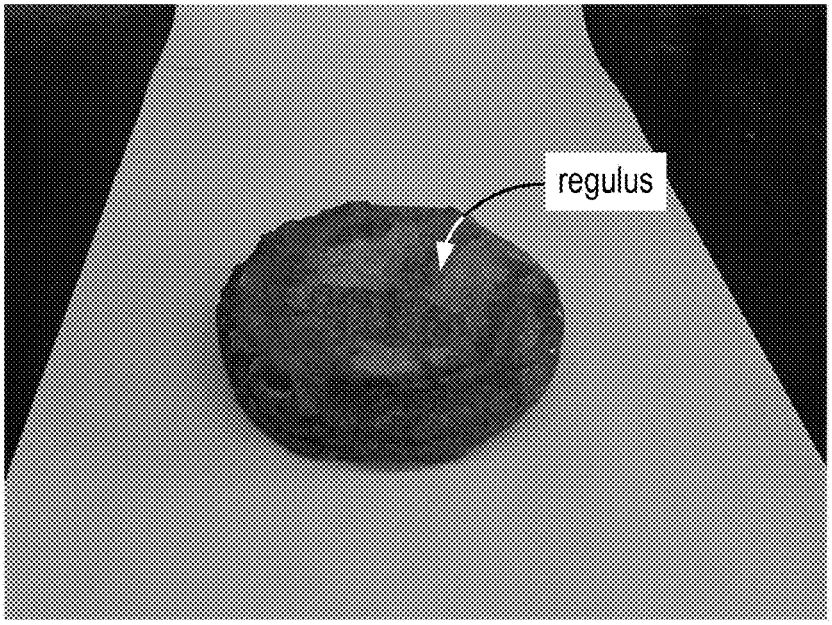
FIG. 2B is a photograph of the regulus shown in FIG. 2A after removal of the slag phase.

FIG. 2A is a photograph showing aluminothermic reaction products comprising a well-defined regulus and a well-defined slag phase. During and/or after an aluminothermic reaction, the oxide reaction products may coalesce into a less dense slag phase and the metallic reaction products coalesce into a denser alloy phase. The phases may separate and solidify into a well-defined alloy regulus and a separated slag phase, as shown in FIG. 2A, for example. FIG. 2B is a photograph of the regulus shown in FIG. 2A after removal of the slag phase. The metallic reaction products of aluminothermic reactions may coalesce and solidify to produce a monolithic, fully-consolidated, and non-brittle alloy regulus, as shown in FIG. 2B, for example.

The use of aluminothermic reactions to produce tantalum alloys or niobium alloys involves the selection of reactants to produce: (1) the specified alloy constituents; (2) volatile (sacrificial) alloy constituents that decrease the melting point temperature of the resulting tantalum-base alloy intermediate or niobium-base alloy intermediate; and (3) sufficient heat to achieve reaction temperatures that will cause the metal reaction products to melt and coalesce into a tantalum-base alloy or niobium-base alloy, and also cause molten slag reaction products to phase separate from the molten metal reaction products so that the molten reaction products solidify to produce a monolithic, fully-consolidated, and non-brittle tantalum alloy or niobium alloy regulus and a separate slag phase.

Tantalum alloys that can be produced using the processes described in this specification include, for example, binary tantalum-niobium alloys (e.g., Ta-40Nb (UNS R05240)) and binary tantalum-tungsten alloys (e.g., Ta-2.5W (UNS R05252) and Ta-10W (UNS R05255)). Ta-40Nb nominally comprises, by weight, 40% niobium, balance tantalum and incidental impurities; Ta-2.5W nominally comprises, by weight, 2.5% tungsten, balance tantalum and incidental impurities; and Ta-10W nominally comprises, by weight, 10% tungsten, balance tantalum and incidental impurities. Niobium alloys that can be produced using the processes described in this specification include, for example, binary Nb—Ta alloys such as, for example, Nb-7.5Ta (nominally 7.5% tantalum by weight, balance niobium and incidental impurities), binary Nb—Ti alloys comprising, for example, 40-55% titanium by weight, or any sub-range or value subsumed therein, such as, for example, 47-53% titanium), binary Nb—Zr alloys, ternary Nb—Ti—Ta alloys, ternary Nb—Zr—Ta alloys, and multi-component alloys such as alloys comprising, in weight percent, 9.0-11.0% hafnium, 0.7-1.3% titanium, up to 0.7% zirconium, up to 0.5% tantalum, up to 0.5% tungsten, balance niobium and incidental impurities.

To produce a specified tantalum alloy or niobium alloy chemistry for example, in various embodiments, the reactants may comprise aluminum metal powder (as the reducing agent), tantalum pentoxide powder (as the tantalum source and an oxidizing agent), and/or niobium pentoxide powder (as a niobium source and an oxidizing agent). In other embodiments, to produce a specified tantalum-tungsten alloy chemistry for example, the reactants may comprise aluminum metal powder (as the reducing agent), tantalum pentoxide powder (as the tantalum source and an oxidizing agent), and tungsten trioxide powder (as a tungsten source and an oxidizing agent). In other embodiments, to produce a specified tantalum-tungsten alloy chemistry for example, the reactants may comprise aluminum metal powder (as the reducing agent), tantalum pentoxide powder (as the tantalum source and an oxidizing agent), and tungsten metal powder (as an inert tungsten source). In other embodiments, to produce a specified niobium-titanium alloy chemistry, for example, the reactants may comprise aluminum metal powder (as the reducing agent), niobium pentoxide powder (as the niobium source and an oxidizing agent), and titanium dioxide powder (as a titanium source and an oxidizing agent). Reactive or inert sources of other alloying constituents for tantalum-base alloys or niobium-base alloys produced by aluminothermic reactions may be determined by persons skilled in the art on the basis of the targeted alloy composition to be produced and in view of the information disclosed in this specification.

Tantalum and tantalum-base alloys such as Ta-40Nb, Ta-2.5W, and Ta-1 OW have relatively high melting point temperatures. For example, pure tantalum melts at 3020° C., Ta-40Nb melts at 2705° C., Ta-2.5W melts at 3005° C., and Ta-10W melts at 3030° C. Niobium and niobium-base alloys have similarly high melting point temperatures. Because of these relatively high melting point temperatures, aluminothermic reactants may be selected to produce metal products that form volatile (sacrificial) alloy constituents. The volatile (sacrificial) alloy constituents facilitate the liquefaction and coalescence of the metal products produced through the aluminothermic reactions into a tantalum-base alloy or a niobium-base alloy by decreasing the melting point temperature of the alloy. As used herein, the term "volatile (sacrificial) alloy constituent(s)" refers to elements such as copper and iron that are relatively more volatile than the specified constituents of tantalum alloys or niobium alloys (e.g., Ta, Nb, W, Mo, Ti, Zr, Hf, V, Cr) and, therefore, may be readily reduced to incidental impurity levels in tantalum-base alloys or niobium-base alloys refined using electron beam melting. The precursor reactant(s) used to produce "volatile (sacrificial) alloy constituent(s)" may be referred to as "sacrificial metal oxide(s)."

The addition of iron as an alloying element to tantalum or niobium decreases the melting point temperature. For example, tantalum containing 5% iron by weight melts at 2500° C. as compared to 3020° C. for pure tantalum. Likewise, copper lowers the melting point temperature of tantalum, niobium, tantalum alloys, and niobium alloys. Iron and copper are also readily formed by the aluminothermic reduction of iron (III) oxide and copper (II) oxide, respectively, and both aluminothermic reactions generate large amounts of heat, resulting in high reaction temperatures. Iron and copper are also relatively more volatile than tantalum, niobium, tungsten, molybdenum, titanium, zirconium, and hafnium, and are therefore readily removed from a tantalum alloy matrix using electron beam melting.

In various embodiments, sacrificial metal oxide reactants may comprise iron (III) oxide powder, copper (II) oxide powder, or both. Other sacrificial metal oxide reactant powders that may be suitable for purposes of generating reaction heat and producing volatile (sacrificial) elements that decrease the melting point temperatures of the resulting tantalum-base alloys include, for example, manganese dioxide, nickel (II) oxide, cobalt (II) oxide, chromium oxides, and molybdenum oxides. While these additional sacrificial oxides may be reactive in aluminothermic reactions, these oxides may be less suitable than iron (III) oxide and copper (II) oxide for the aluminothermic production of tantalum-base alloys or niobium-base alloys because of the metal components of these additional oxides are relatively less volatile than iron and copper and, therefore, are not as readily removed by electron beam refining or otherwise. However, these additional oxides may alternatively function as non-sacrificial oxides that provide the metal components as alloying additions to tantalum-base alloys or niobium-base alloys produced in accordance with this specification.

Like iron (III) oxide and copper (II) oxide, manganese dioxide powder is reduced by aluminum powder with considerable release of reaction heat. Sacrificial manganese in a resulting tantalum-base alloy may also be readily removed using electron beam melting. However, the boiling point temperature of manganese (2060° C.) is significantly less than the boiling point temperatures of copper and iron (2562° C. and 2862° C., respectively); therefore, manganese may restrict the temperature of aluminothermic reactions involving tantalum pentoxide, which may result in inadequate alloy-slag phase separation. Nickel (II) oxide and cobalt (II) oxide do not react with aluminum as energetically as iron (III) oxide and copper (II) oxide. Nickel and cobalt metals also tend to form intermetallic compounds with tantalum. Chromium oxides such as $Cr_2O_3$ may also be used in various embodiments. Molybdenum metal has a significantly lower vapor pressure as compared to the vapor pressures of iron and copper and, therefore, molybdenum may not be as readily removed from a tantalum alloy matrix as iron and copper during electron beam melting, but, as noted above, may be used as a precursor oxide that provides molybdenum alloying to tantalum-base alloys or niobium-base alloys.

To produce sufficient heat to achieve reaction temperatures that cause alloy formation and slag phase separation, in various embodiments, the reactants may also comprise an aluminothermic accelerator. An aluminothermic accelerator is a reactant compound that oxidizes aluminum and generates large amounts of reaction heat, but does not produce a reduced metal value that coalesces into a tantalum alloy matrix or a niobium alloy matrix. Examples of thermal accelerator reactants include, for example, potassium chlorate and barium peroxide.

In various embodiments, the reactants may comprise barium peroxide powder. Barium peroxide reacts with aluminum under aluminothermic reaction conditions to produce barium oxide and aluminum oxide. Barium oxide has a favorable phase relationship with aluminum oxide and slags comprising a mixture of barium oxide and aluminum oxide have significantly lower melting point temperatures than slags comprising mostly aluminum oxide. For example, a composition of 32 mol% barium oxide in aluminum oxide has a melting point temperature of 1870° C. as compared to 2072° C. for pure aluminum oxide. Therefore, slags comprising a mixture of barium oxide and aluminum oxide reaction products will more readily phase separate from liquefied and coalesced tantalum alloy or niobium alloy under aluminothermic reaction conditions, which facilitates the production of a monolithic, fully-consolidated, and non-brittle tantalum alloy or niobium alloy regulus and a separated slag phase. In various embodiments, the reactants may be substantially free of potassium chlorate, which means that potassium chlorate is present in the reactant mixture at no greater than incidental impurity levels.

A process for the production of tantalum alloys or niobium alloys may comprise conducting an aluminothermic reaction between reactants comprising aluminum metal powder (Al), tantalum pentoxide powder ($Ta_2O_5$), niobium pentoxide powder ($Nb_2O_5$), at least one of iron (III) oxide powder ($Fe_2O_3$) and copper (II) oxide powder (CuO), and barium peroxide powder ($BaO_2$). The aluminothermic reactions may proceed, for example, according to the following chemical equations:

$$3\ Ta_2O_5+10\ Al \rightarrow 6\ Ta+5\ Al_2O_3$$

$$3\ Nb_2O_5+10\ Al \rightarrow 6\ Nb+5\ Al_2O_3$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle tantalum alloy regulus or niobium alloy regulus. A tantalum-base alloy may comprise niobium, iron, copper, aluminum, and balance tantalum and incidental impurities, and a niobium-base alloy may comprise tantalum, iron, copper, aluminum, and balance niobium and incidental impurities. The iron, copper, and aluminum may be reduced to incidental impurity levels by electron beam melting the tantalum alloy or niobium alloy regulus to produce a refined tantalum alloy or niobium alloy ingot.

A process for the production of tantalum alloys may comprise conducting an aluminothermic reaction between reactants comprising aluminum metal powder (Al), tantalum pentoxide powder ($Ta_2O_5$), tungsten trioxide powder ($WO_3$), at least one of iron (III) oxide powder ($Fe_2O_3$) and copper (II) oxide powder (CuO), and barium peroxide powder ($BaO_2$). The aluminothermic reactions may proceed, for example, according to the following chemical equations:

$$3\ Ta_2O_5+10\ Al \rightarrow 6\ Ta+5\ Al_2O_3$$

$$WO_3+2\ Al \rightarrow W+Al_2O_3$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle tantalum alloy regulus. The tantalum-base alloy may comprise tungsten, iron, copper, aluminum, and balance tantalum and incidental impurities. The iron, copper, and aluminum may be reduced to incidental impurity levels by electron beam melting the tantalum alloy regulus to produce a refined tantalum alloy ingot.

A process for the production of tantalum alloys may comprise conducting an aluminothermic reaction between reactants comprising aluminum metal powder (Al), tungsten metal powder (W), tantalum pentoxide powder ($Ta_2O_5$), at least one of iron (III) oxide powder ($Fe_2O_3$) and copper (II) oxide powder (CuO), and barium peroxide powder ($BaO_2$). The aluminothermic reactions may proceed, for example, according to the following chemical equations:

$$3\ Ta_2O_5+10\ Al \rightarrow 6\ Ta+5\ Al_2O_3$$

$$W \rightarrow W$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle tantalum alloy regulus. The tantalum-base alloy may comprise tungsten, iron, copper, aluminum, and balance tantalum and incidental impurities. The iron, copper, and aluminum may be reduced to incidental impurity levels by electron beam melting the tantalum alloy regulus to produce a refined tantalum alloy ingot.

A process for the production of tantalum alloys may comprise conducting an aluminothermic reaction between reactants comprising aluminum metal powder (Al), tantalum pentoxide powder ($Ta_2O_5$), molybdenum trioxide powder ($MoO_3$), at least one of iron (III) oxide powder ($Fe_2O_3$) and copper (II) oxide powder (CuO), and barium peroxide powder ($BaO_2$). The aluminothermic reactions may proceed, for example, according to the following chemical equations:

$$3\ Ta_2O_5+10\ Al \rightarrow 6\ Ta+5\ Al_2O_3$$

$$MoO_3+2\ Al \rightarrow Mo+Al_2O_3$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle tantalum alloy regulus. The tantalum-base alloy may comprise molybdenum, iron, copper, aluminum, and balance tantalum and incidental impurities. The iron, copper, and aluminum may be reduced to incidental impurity levels by electron beam melting the tantalum alloy regulus to produce a refined tantalum alloy ingot.

A process for the production of niobium alloys may comprise conducting an aluminothermic reaction between reactants comprising aluminum metal powder (Al), niobium pentoxide powder ($Nb_2O_5$), molybdenum trioxide powder ($MoO_3$), at least one of iron (III) oxide powder ($Fe_2O_3$) and copper (II) oxide powder (CuO), and barium peroxide powder ($BaO_2$). The aluminothermic reactions may proceed, for example, according to the following chemical equations:

$$3\ Nb_2O_5+10\ Al \rightarrow 6\ Nb+5\ Al_2O_3$$

$$MoO_3+2\ Al \rightarrow Mo+Al_2O_3$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle niobium alloy regulus. The niobium-base alloy may comprise molybdenum, iron, copper, aluminum, and balance niobium and incidental impurities. The iron, copper, and aluminum may be reduced to incidental impurity levels by electron beam melting the tantalum alloy regulus to produce a refined niobium alloy ingot.

A process for the production of niobium alloys may comprise conducting an aluminothermic reaction between reactants comprising aluminum metal powder (Al), niobium pentoxide powder ($Nb_2O_5$), zirconium dioxide powder ($ZrO_2$), at least one of iron (III) oxide powder ($Fe_2O_3$) and copper (II) oxide powder (CuO), and barium peroxide powder ($BaO_2$). The aluminothermic reactions may proceed, for example, according to the following chemical equations:

$$3\ Nb_2O_5+10\ Al \rightarrow 6\ Nb+5\ Al_2O_3$$

$$3\ ZrO_2+4\ Al \rightarrow 3\ Zr+2\ Al_2O_3$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle niobium alloy regulus. The niobium-base alloy may comprise zirconium, iron, copper, aluminum, and balance niobium and incidental impurities. The iron, copper, and aluminum may be reduced to incidental impurity levels by electron beam melting the niobium alloy regulus to produce a refined niobium alloy ingot.

A process for the production of niobium alloys may comprise conducting an aluminothermic reaction between reactants comprising aluminum metal powder (Al), niobium pentoxide powder ($Nb_2O_5$), titanium dioxide powder ($ZrO_2$), at least one of iron (III) oxide powder ($Fe_2O_3$) and copper (II) oxide powder (CuO), and barium peroxide powder ($BaO_2$). The aluminothermic reactions may proceed, for example, according to the following chemical equations:

$$3\ Nb_2O_5+10\ Al\ 6\ Nb+5\ Al_2O_3$$

$$3\ TiO_2+4\ Al \rightarrow 3\ Ti+2\ Al_2O_3$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle niobium alloy regulus. The niobium-base alloy may comprise titanium, iron, copper, aluminum, and balance niobium and incidental impurities. The iron, copper, and aluminum may be reduced to incidental impurity levels by electron beam melting the niobium alloy regulus to produce a refined niobium alloy ingot.

A process for the production of niobium alloys may comprise conducting an aluminothermic reaction between reactants comprising aluminum metal powder (Al), niobium pentoxide powder ($Nb_2O_5$), at least one of iron (III) oxide powder ($Fe_2O_3$) and copper (II) oxide powder (CuO), barium peroxide powder ($BaO_2$), and any combination or sub-combination of zirconium dioxide powder ($ZrO_2$), titanium dioxide powder ($ZrO_2$), hafnium dioxide powder ($HfO_2$), tantalum pentoxide powder ($Ta_2O_5$), and tungsten trioxide powder ($WO_3$) and/or tungsten metal. The aluminothermic reactions may proceed, for example, according to the following chemical equations:

$$3\ Nb_2O_5+10\ Al \rightarrow 6\ Nb+5\ Al_2O_3$$

$$3\ ZrO_2+4\ Al \rightarrow 3\ Zr+2\ Al_2O_3$$

$$3\ TiO_2+4\ Al \rightarrow 3\ Ti+2\ Al_2O_3$$

$$3\ HfO_2+4\ Al \rightarrow 3\ Hf+2\ Al_2O_3$$

$$3\ Ta_2O_5+10\ Al \rightarrow 6\ Ta+5\ Al_2O_3$$

$$WO_3+2\ Al \rightarrow W+Al_2O_3$$

$$W \rightarrow W$$

$$Fe_2O_3+2\ Al \rightarrow 2\ Fe+Al_2O_3$$

$$3\ CuO+2\ Al \rightarrow 3\ Cu+Al_2O_3$$

$$3\ BaO_2+2\ Al \rightarrow 3\ BaO+Al_2O_3$$

The products of the aluminothermic reactions may include a slag phase comprising a mixture of aluminum oxide ($Al_2O_3$) and barium oxide (BaO), and a separate monolithic, fully-consolidated, and non-brittle niobium alloy regulus. The niobium-base alloy may comprise zirconium, titanium, hafnium, tantalum, tungsten, iron, copper, aluminum, and balance niobium and incidental impurities. The iron, copper, and aluminum may be reduced to incidental impurity levels by electron beam melting the niobium alloy regulus to produce a refined niobium alloy ingot.

The aluminothermic reactant mixtures used in the processes described in this specification to produce tantalum alloys or niobium alloys may comprise aluminum metal powder, tantalum pentoxide powder and/or niobium pentoxide powder, and any combination or sub-combination of alloying element precursor powders, sacrificial metal oxide powders, and/or aluminothermic accelerator powders. For example, the aluminothermic reactant mixtures may comprise any combination or sub-combination of reactant powders including aluminum, tantalum pentoxide ($Ta_2O_5$), niobium pentoxide ($Nb_2O_5$), molybdenum trioxide ($MoO_3$), titanium dioxide ($TiO_2$), zirconium dioxide ($ZrO_2$), hafnium dioxide ($HfO_2$), vanadium pentoxide ($V_2O_5$), tungsten trioxide ($WO_2$), chromium (III) oxide ($Cr_2O_3$), iron (III) oxide ($Fe_2O_3$), copper (II) oxide (CuO), manganese dioxide ($MnO_2$), nickel (II) oxide (NiO), cobalt (II) oxide (CoO), and/or barium peroxide ($BaO_2$). The metal oxide alloying element precursor powders are chemically reduced by the aluminum to the corresponding metal. In addition or as an alternative to metal oxide alloying element precursor powders, the aluminothermic reactant mixtures may comprise any combination or sub-combination of aluminothermically inert metallic powders that provide alloying elements in addition to any allowing elements provided by the aluminothermically reduced reaction products. For example, the aluminothermic reactant mixtures may comprise any combination or sub-combination of tungsten powder, molybdenum powder, titanium powder, zirconium powder, hafnium powder, vanadium powder, and/or chromium powder.

The composition and relative amounts of the reactant powders (and inert powders, if used) may be based on the metallurgical composition of a specified tantalum alloy or niobium alloy target and the stoichiometry of the aluminothermic reactions. For example, to produce a Ta-40Nb alloy target, a 60:40 Ta:Nb weight ratio, on a metal weight basis, may be specified in a reactant feed comprising tantalum pentoxide and niobium pentoxide. To produce a Ta-2.5W alloy target, for example, a 97.5:2.5 Ta:W weight ratio, on a metal weight basis, may be specified in a reactant feed comprising tantalum pentoxide and tungsten metal or tungsten trioxide. The relative metal weight ratios of the tantalum metal precursor ($Ta_2O_5$) and the specified alloying element precursors, such as, for example, a niobium metal precursor ($Nb_2O_5$) or a tungsten metal precursor (W or $WO_3$), may be adjusted to account for yield losses to the slag phase, which may reduce the relative amount of a metal (e.g., Ta, Nb, or W) comprising the regulus product.

In embodiments where the targeted alloy composition comprises a tungsten-containing tantalum-base alloy such as Ta-2.5W, tungsten metal powder may be used as an inert tungsten precursor to provide the tungsten metal for alloying the tantalum metal produced from the aluminothermically reduced tantalum pentoxide precursor. A tungsten metal powder may be referred to as a "reactant" or "precursor" for the provision of tungsten to alloy tantalum, notwithstanding the fact that the tungsten metal powder may be chemically inert under aluminothermic reaction conditions and remain in a zero (elemental) oxidation state)($W^o$ during the reactions. The tungsten metal precursor in such embodiments does not contribute to any heat generation during the aluminothermic reactions. Instead, the tungsten metal precursor functions as a heat sink in the reaction mixture, which decreases the otherwise available exothermic reaction heat energy and reaction temperature. Accordingly, an excessive amount of tungsten in the initial reactant mixture may present an impediment to reactant conversion yield and alloy-slag phase separation. In various embodiments comprising a tungsten metal precursor in the reactant mixture, the amount of tungsten may be limited to an amount up to 7% of the reactant mixture on a total metal weight basis.

The relative amount of the sacrificial metal oxide powder (such as, for example, iron (III) oxide powder, copper (II) oxide powder, or both) in the initial reactant mixture is not determined by the metallurgical composition of a specified tantalum alloy or niobium alloy target because the resulting metal reaction products (e.g., Fe and/or Cu) of the aluminothermic reactions may be removed or reduced to incidental impurity levels in a tantalum alloy or niobium alloy matrix by downstream electron beam melting. Instead, the relative amounts of the sacrificial metal oxide powder reactants are determined by balancing the alloy melting point temperature reduction and the formation of undesired alloy phases due to the presence of the sacrificial alloy constituents in the tantalum alloy or niobium alloy matrix.

As previously described, the addition of relatively low amounts of iron to tantalum or niobium as an alloy constituent significantly decreases the melting point temperature of the alloy. The aluminothermic reduction of iron (III) oxide to iron also generates a relatively large amount of reaction heat as compared to the aluminothermic reduction of other metal oxides to elemental metals. However, at concentrations of 21% by weight or more, iron does not completely dissolve in tantalum and forms a brittle intermetallic TaFe compound that precipitates from the tantalum matrix and forms phases that severely embrittle the bulk alloy material. Furthermore, as a sacrificial element, any iron present in a tantalum alloy or niobium alloy regulus produced by an aluminothermic reaction process may ultimately need to be removed or reduced to incidental impurity levels by downstream electron beam melting. Therefore, the relative amount of an iron (III) oxide powder reactant may be limited to ensure that a resulting tantalum alloy or niobium alloy regulus comprises less than 21% by weight of the alloy regulus.

Like iron, the addition of relatively low amounts of copper to tantalum or niobium as an alloy constituent decreases the melting point temperature of the alloy. The heat of reaction for the aluminothermic reduction of copper (II) oxide to copper metal is not as great as the heat of reaction for the aluminothermic reduction of iron (III) oxide to iron. However, unlike iron, copper does not form any detrimental intermetallic compounds with tantalum over the entire compositional range. Instead, at ambient temperatures, copper and tantalum are essentially immiscible and form separate, relatively ductile metallic phases. In various embodiments, copper (II) oxide powder may be used as a sacrificial metal oxide reactant instead of or in addition to iron (III) oxide. Accounting for the specified tantalum-base alloy or niobium-base alloy composition to be produced by an aluminothermic reaction process, suitable combinations of iron (III) oxide and copper (II) oxide powder reactants may be readily determined that: (1) facilitate metal liquefaction and coalescence of tantalum-base alloys or niobium-base alloys under aluminothermic reaction conditions; (2) do not result in the formation of brittle intermetallic phases in the solid tantalum alloy or niobium alloy regulus product; (3) facilitate alloy-slag phase separation; and (4) produce iron and/or copper alloy concentrations that are readily removed or reduced to incidental impurity levels by downstream electron beam melting of the regulus.

The relative amount of an aluminothermic accelerator reactant, such as, for example, barium peroxide, may be determined by the amount of heat energy necessary to ensure liquefaction and coalescence of aluminothermically reduced metals such as, for example, tantalum, niobium, iron, copper, tungsten, molybdenum, titanium, zirconium, hafnium, vanadium, chromium, manganese, cobalt, nickel, or combinations of any thereof, and also the liquefaction and coalescence of tungsten metal powder, if present, into the tantalum alloy or niobium alloy matrix. The relative amount of an aluminothermic accelerator reactant comprising barium peroxide may also be based in part on the melting point depression of the resulting slag phase comprising aluminum oxide and barium oxide reaction products, which will more readily phase separate from liquefied and coalesced tantalum alloy or niobium alloy under aluminothermic reaction conditions.

As described above, the aluminum powder reactant functions as a reducing agent that is oxidized by at least the tantalum pentoxide and/or niobium pentoxide reactant, the sacrificial metal oxide reactant(s), and the aluminothermic accelerator reactant. Similar to iron, aluminum at concentrations of approximately 4-6% by weight or more does not completely dissolve in tantalum and forms a brittle intermetallic $Ta_2Al$ compound that precipitates from the tantalum matrix, even in a molten state, and forms phases that severely embrittle the solidified bulk alloy material. Accordingly, it may be important control the amount of aluminum powder in an initial reactant mixture to ensure the presence of a stoichiometrically sufficient amount for the aluminothermic reactions, while also preventing excess aluminum from forming intermetallic $Ta_2Al$ compounds in a resulting alloy regulus product. In various embodiments, the amount of aluminum powder in an initial reactant mixture may comprise up to 5.0% excess of the stoichiometric requirement on a mole basis. The amount of aluminum powder in an initial reactant mixture may comprise up to 4.0% excess of the stoichiometric requirement on a mole basis. The amount of aluminum powder in an initial reactant mixture may comprise from 0.0% to 5.0% excess of the stoichiometric requirement on a mole basis, or any sub-range subsumed therein, such as, for example, 1.0% to 5.0%, 2.0% to 5.0%, 3.0% to 5.0%, 1.0% to 4.0%, 2.0% to 4.0%, or 3.0% to 4.0%.

In various embodiments, a process for the production of a tantalum alloy or a niobium alloy may comprise mixing a reactant mixture comprising aluminum metal powder, tantalum pentoxide and/or niobium pentoxide powder, an alloying element precursor powder (e.g., tungsten metal, tungsten trioxide, molybdenum trioxide, titanium dioxide, zirconium dioxide, hafnium dioxide, and/or vanadium pentoxide), at least one sacrificial metal oxide powder (e.g., iron (III) oxide and/or copper (II) oxide), and at least one aluminothermic accelerator powder (e.g., barium peroxide). Reactant powders should be thoroughly dry to prevent the potential formation of steam during the aluminothermic reactions. For example, in various embodiments, the moisture content, determined as loss on ignition (L01), for each reactant powder may be less than 0.5%, 0.4%, 0.3%, or 0.2%. The reactant powders should also be finely divided. For example, in various embodiments, the reactant powders may have a particle size distribution of greater than 85% by weight passing a 200 U.S. mesh (-200 mesh, <74 micrometer, <0.0029 inch).

The reactant powders may be individually weighed and mixed together using standard powder mixing equipment such as, for example, a double-cone blender, a twin shell (vee) blender, or a vertical screw mixer. In various embodiments, the reactant powder may be mixed for at least 10 minutes, and in some embodiments, for at least 20 minutes, to ensure macroscopically homogeneous mixing. After mixing, the reactant mixture may be loaded into a reaction vessel.

Figure 3:
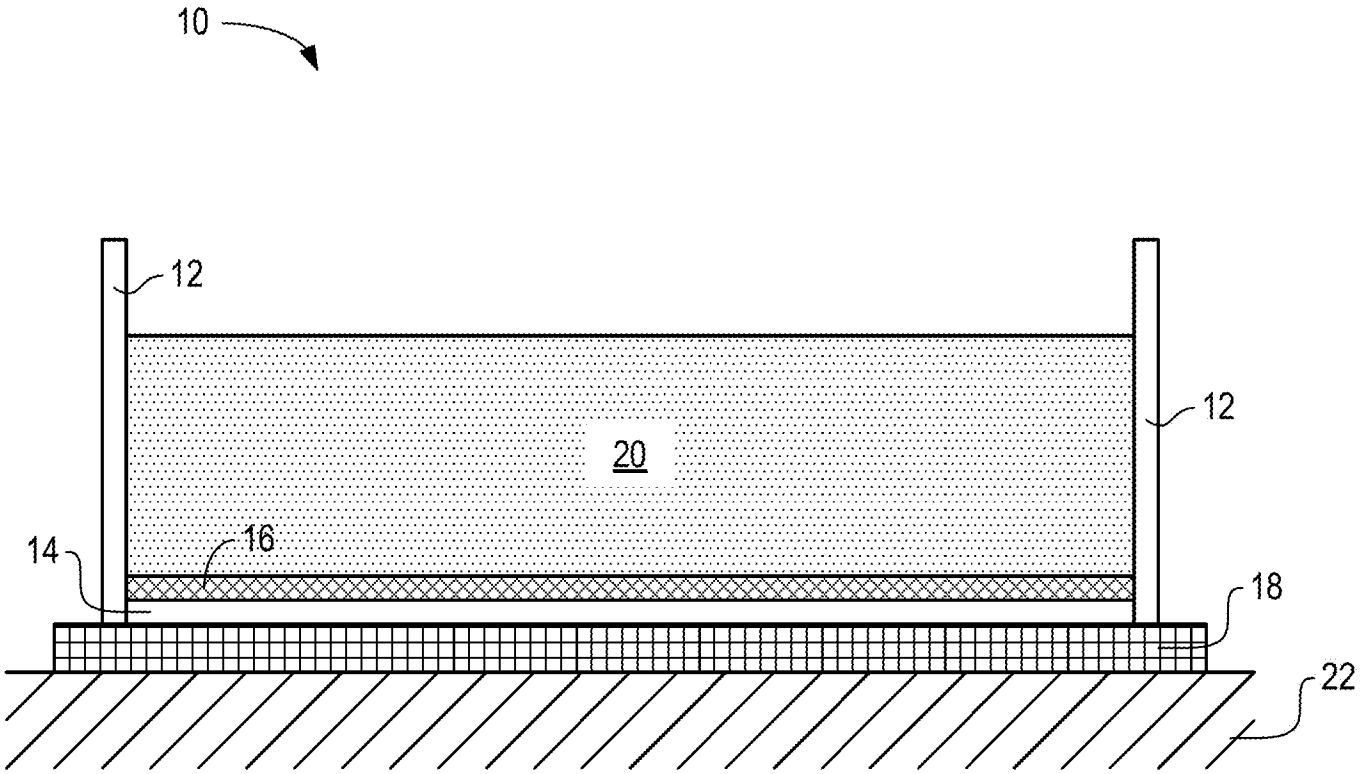
FIG. 3 is a cross-sectional schematic diagram (not to scale) of an aluminothermic reaction vessel.

Referring to FIG. 3, a reaction vessel 10 comprises vessel sidewalls 12 and vessel bottom 14. The vessel sidewalls 12 and the vessel bottom 14 may comprise a material that maintains structural integrity when subjected to the high levels of heat and high temperatures achieved during aluminothermic reactions. For example, the vessel sidewalls 12 and the vessel bottom 14 may be fabricated from extruded, compression-molded, or iso-molded graphite. The vessel sidewalls 12 and the vessel bottom 14 may comprise coarse-grained, medium-grained, or fine-grained graphite.

For example, in various embodiments, reaction vessel sidewalls may comprise coarse-grained or medium-grained extruded graphite and a reaction vessel bottom may comprise fine-grained iso-molded (i.e., isostatically pressed) graphite. While not intending to be bound by theory, it is believed that the finer grain size of fine-grained iso-molded graphite provides greater physical robustness and structural integrity to the reaction vessel bottom against erosion by the molten aluminothermic reaction products. The fine-grained iso-molded graphite is also believed to provide a contacting surface characterized by decreased porosity, which effectively excludes more molten material than coarser grained material. Fine-grained iso-molded graphite is more expensive than coarse-grained or medium-grained graphite and therefore, cost considerations may dictate that the reaction vessel bottom comprise fine-grained iso-molded graphite because of the reactant and product load bearing down onto the reaction vessel bottom, and the reaction vessel sidewalls comprise less expensive coarser grained graphite material. Nevertheless, in various embodiments, the reaction vessel sidewalls may comprise fine-grained iso-molded graphite. Likewise, the reaction vessel bottom may comprise coarser grained graphite material.

The thickness of the vessel sidewalls and the vessel bottom should be sufficient to maintain structural integrity when subjected to the high heat and temperatures produced during the aluminothermic reduction reactions. In various embodiments, the vessel sidewalls and the vessel bottom may be at least 1-inch thick. The specific geometry (shape and dimensions) of the reaction vessel is not necessarily limited. However, in various embodiments, the specific geometry of the reaction vessel may be determined by the input configuration of a downstream electron beam melting furnace. In such embodiments, the specific geometry of the reaction vessel may be selected to produce a tantalum alloy or niobium alloy regulus having a geometry (shape and dimensions) that permits the regulus to be directly electron beam melted in an electron beam furnace to produce a refined tantalum alloy or niobium alloy ingot.

Referring again to FIG. 3, the vessel sidewalls 12 and the vessel bottom 14 may be mechanically fastened together to form the reaction vessel 10. Alternatively, the reaction vessel 10, comprising the vessel sidewalls 12 and the vessel bottom 14, may be formed as a monolithic and contiguous vessel fabricated from material such as graphite using compression molding or iso-molding techniques, for example.

The reaction vessel 10 is positioned on top of a layer of refractory material 18. The layer of refractory material 18 may comprise a refractory material such as, for example, fire clay bricks or other ceramic-based materials used for high temperature industrial applications. The layer of refractory material 18 may be positioned on top of an elevated concrete slab 22. Alternatively, the layer of refractory material 18 may be positioned directly onto a suitable floor surface (e.g., concrete) in a plant or shop (not shown).

The reaction vessel 10 may comprise a layer of magnesium oxide 16 positioned on at least the vessel bottom 14. The magnesium oxide layer 16 provides a barrier between the vessel bottom 14 and the reactant mixture 20, which is positioned on top of the magnesium oxide layer 16, as shown in FIG. 3.

While not intending to be bound by theory, during the development of the processes described in this specification, cracking of tantalum alloy reguli produced through aluminothermic reactions was observed when the reguli were removed from graphite reaction vessels. The observed cracking of the tantalum alloy reguli occurred notwithstanding the fact that the alloy material itself was subsequently determined to be relatively ductile. This behavior was attributed, at least in part, to a possible hot tearing mechanism wherein the alloy material produced by the aluminothermic reactions would stick to the interior surfaces of the graphite reaction vessel during liquefaction, coalescence, solidification, and cooling. Again, while not intending to be bound by theory, it is believed that this possible hot tearing may have resulted from the formation and growth of carbides at the interface between the newly-formed alloy material and the graphite reaction vessel. The application of a magnesium oxide layer to the interior bottom surface of the reaction vessel was found to eliminate the observed cracking.

In various embodiments, a reaction vessel for the aluminothermic production of tantalum alloys or niobium alloys may comprise a layer of magnesium oxide positioned on at least the interior bottom surface of the reaction vessel. The magnesium oxide layer functions as a barrier between the reactant powder mixture and the bottom of the reaction vessel. The magnesium oxide layer may comprise a layer of magnesium oxide powder positioned on the bottom of the reaction vessel. In various embodiments, a refractory grade magnesium oxide powder in a heavy/dead-burned state (i.e., calcined at a temperature greater than 1500° C. to eliminate reactivity) may be used. A magnesium oxide powder layer may be positioned in the reaction vessel immediately before the reaction vessel is loaded with the reactant mixture.

Figure 4:
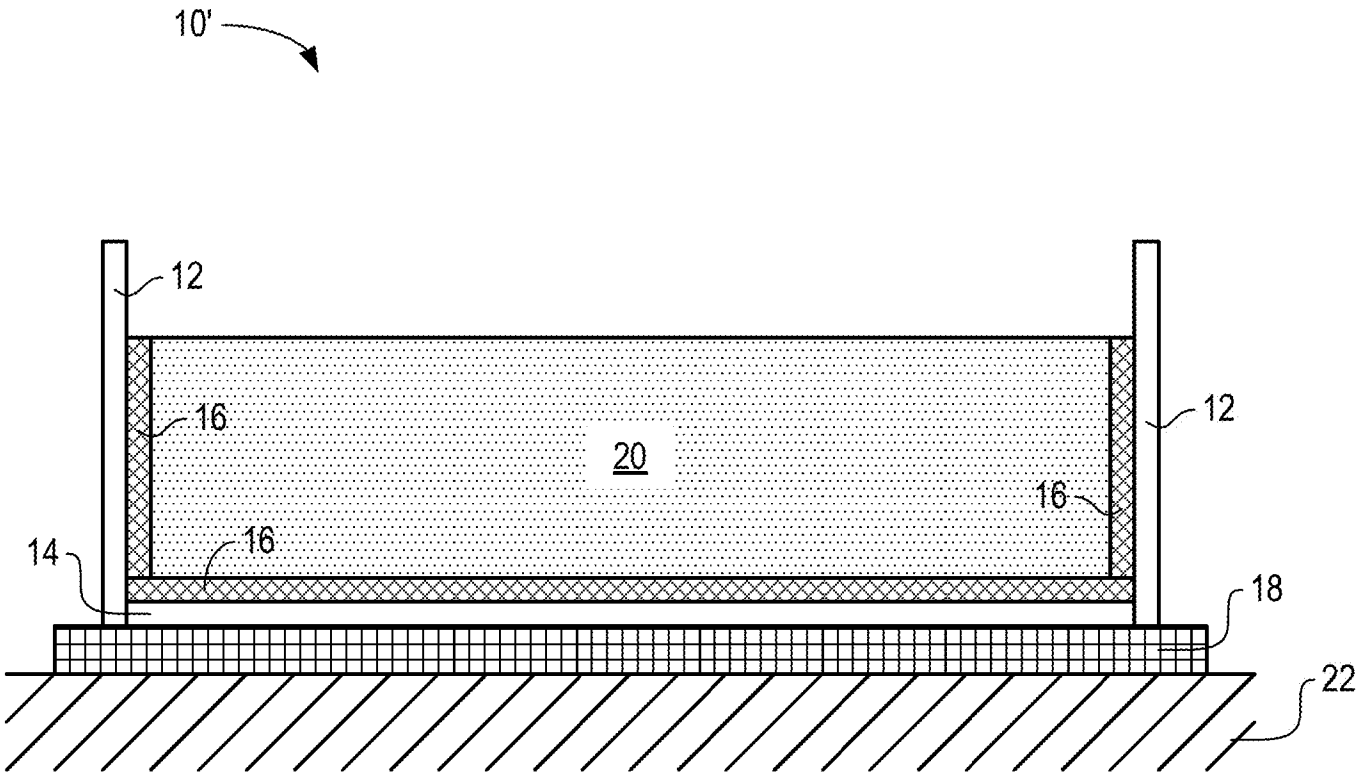
FIG. 4 is a cross-sectional schematic diagram (not to scale) of an aluminothermic reaction vessel.

A magnesium oxide layer may be positioned on at least the interior bottom surface of a reaction vessel, but may optionally be applied to the sidewalls of a reaction vessel. Referring to FIG. 4, a reaction vessel 10' is shown comprising a magnesium oxide layer 16 positioned on the vessel bottom 14 and the vessel sidewalls 12.

In various embodiments, a layer of magnesium oxide may be positioned in a reaction vessel as a thermally-sprayed coating layer applied to the sidewalls of the reaction vessel and/or the bottom of the reaction vessel. A thermally-sprayed magnesium oxide coating layer may have advantages such as, for example, greater structural integrity, lower porosity, and uniform thickness. In various embodiments, a layer of magnesium oxide may be may be positioned in a reaction vessel by applying a paint composition comprising magnesium oxide particles to the sidewalls of the reaction vessel and/or the bottom of the reaction vessel. In various embodiments, a layer of magnesium oxide may be positioned in a reaction vessel by positioning magnesium oxide sheets or wallboards immediately adjacent to the sidewalls of the reaction vessel and/or the bottom of the reaction vessel.

While other ceramic materials may be used instead of a magnesium oxide to provide a barrier layer in a reaction vessel, such other materials may not be as effective as magnesium oxide and may be reactive under aluminothermic conditions. For example, refractory materials such as silicon dioxide and zirconium dioxide may be aluminothermically reduced by the aluminum metal powder in a reaction mixture to silicon and zirconium, respectively. Like magnesium oxide, calcium oxide is inert toward aluminothermic reaction, and therefore may be suitable, but calcium oxide is sensitive to air exposure.

In various embodiments, a reactant powder mixture may be loaded into a reaction vessel after positioning a magnesium oxide layer on the sidewalls of the reaction vessel and/or the bottom of the reaction vessel. The loading of the reactant powder mixture may comprise positioning the mixture in the reaction vessel on top of any magnesium oxide layer located on the interior bottom surface of the reaction vessel (see FIGS. 2 and 3, for example). After the reactant powder mixture is loaded into the reaction vessel, an ignition wire is positioned in contact with the reactant powder mixture in the reaction vessel.

Figure 5:
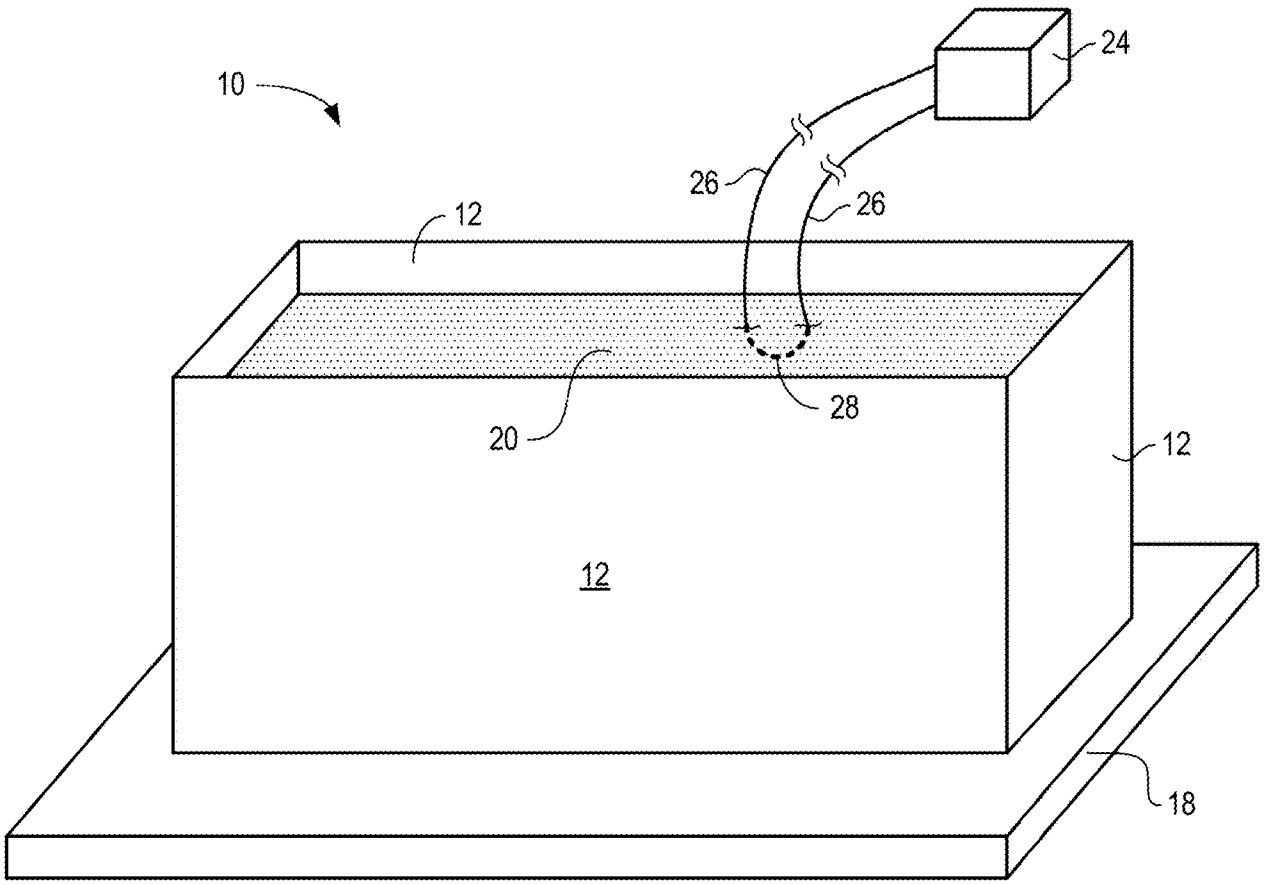
FIG. 5 is a schematic diagram in perspective view (not to scale) of an aluminothermic reaction vessel.

Referring to FIG. 5, an ignition wire 28 is shown submerged into the reactant powder mixture 20 in the reaction vessel 10. The ignition wire 28 is connected to an electrical current source (power supply) 24 by lead and return wires 26.

In various embodiments, the ignition wire may be directly submerged into the reactant powder mixture in the reaction vessel, as shown in FIG. 5. For example, an ignition wire several inches in length may be looped as shown in FIG. 5 and submerged at least two inches into the reactant powder mixture in the reaction vessel. Alternatively, an ignition wire may be positioned inside a plastic starter bag (not shown) that contains aluminum metal powder and any one of or any combination of reducible metal oxides or peroxides such as, for example, tantalum pentoxide, niobium pentoxide, iron (III) oxide, copper (II) oxide, and/or barium peroxide. The starter bag may be positioned directly on top of the reactant powder mixture in the reaction vessel and does not necessarily need to be, but may be, partially or completely submerged into the reactant powder mixture. While not intending to be bound by theory, it is believed that the smaller volume of reactants inside a starter bag may provide a more reproducible environment for reaction ignition than direct contact of an ignition wire submerged within the entire reactant powder mixture in a reaction vessel. Nevertheless, ignition wires may be positioned in contact with a reactant powder mixture by directly submerging the wires in the main reactant mixture or indirectly through starter bags.

The ignition wires may comprise tantalum, niobium, a tantalum alloy, or a niobium alloy, for example. Alternatively, the ignition wires may comprise any high-melting point metal or alloy that is intended to be present in a targeted alloy composition such as, for example, tungsten, tungsten alloys, niobium, and niobium alloys. In some embodiments, the ignition wires may be at least 12 inches in length and comprise a relatively narrow gauge of 20, for example, to create a resistive heating element to ignite the reactant mixture and initiate the aluminothermic reactions. The ignition wire may be connected to a power supply using aluminum wires or copper wires, for example, of sufficient length and gauge to provide an energizing current to the ignition wire. The connection between the ignition wire and the wires connecting to the power supply may comprise a twisted wire connection or a metallic butt-connector, for example.

After an ignition wire is positioned in contact with the reaction mixture, the reaction vessel may be sealed inside a reaction chamber. The specific geometry and construction of a reaction chamber is not necessarily critical, but a reaction chamber should physically contain the reaction vessel and maintain structural integrity when subjected to the heat and temperatures producing during the aluminothermic reactions. A reaction chamber should also be capable of containing any reaction material ejected from the reaction vessel during the reactions. A reaction chamber should also be capable of hermetically sealing the reaction vessel from the surrounding environment.

Figure 6:
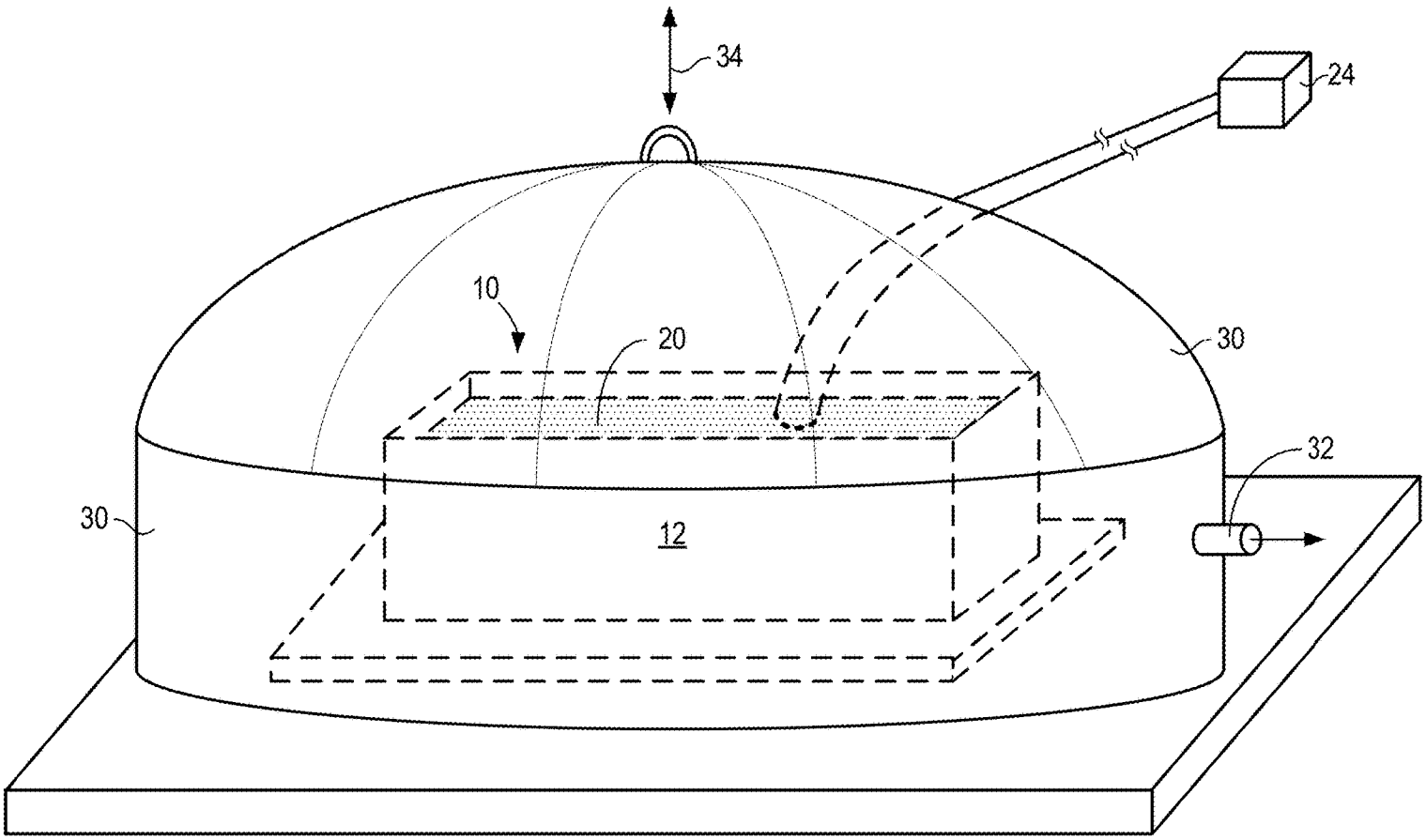
FIG. 6 is a schematic diagram in perspective view (not to scale) of an aluminothermic reaction vessel sealed inside a reaction chamber.

Referring to FIG. 6, a reaction chamber 30 comprising a lid structure is shown sealing the reaction vessel 10 containing the reactant powder mixture 20. The reaction chamber 30 comprises a vacuum port 32 to connect to a vacuum source (not shown), such as a vacuum pump, for establishing a vacuum inside the reaction chamber. The lead and return wires 26 (connecting the ignition wire 28 and the power supply 24) are positioned through electrical ports (not shown) in the reaction chamber 30. After the reactant powder mixture 20 and the ignition wire 28 are positioned in the reaction vessel 10, the reaction vessel 10 is sealed inside the reaction chamber 30 by lowering the reaction chamber over the reaction vessel as indicated by arrow 34. The reaction vessel 30 engages a suitable surface such as a flat base plate with a machined flat edge, for example, or a concrete slab to provide a hermetic seal and permit a vacuum to be established inside the reaction vessel through vacuum port 32. After the aluminothermic reactions are complete and the resulting reaction products have sufficiently cooled, the vacuum may be discontinued and the reaction chamber raised as indicated by arrow 34. The lowering and raising of the reaction vessel 30 may be performed with suitable plant equipment such as, for example, a crane or hoist (not shown). The reaction vessel 30 may comprise any suitable material of construction such as, for example, steel.

The establishment of a vacuum is not necessarily required for the aluminothermic reactions. However, conducting the reactions under a vacuum provides advantages such as neutralizing pressure spikes in the reaction mixture that may eject material from the reaction vessel. Conducting the reactions under a vacuum may also increase the quality of the tantalum alloy or niobium alloy regulus produced by the aluminothermic reactions by decreasing nitrogen and oxygen contamination. The establishment of a vacuum inside a reaction chamber also provides thermal insulation and extends the cooling time of the reaction products, which may further mitigate cracking of the tantalum alloy or niobium alloy regulus during solidification and cooling. Reasonable vacuum pressures are suitable for inside a reaction chamber. For example, a vacuum pressure of less than 100 millitorr may be used.

Initiation of the aluminothermic reactions may comprise energizing the ignition wire. Initiation of the aluminothermic reactions may occur after the reaction vessel is sealed inside a reaction chamber and a vacuum established inside the reaction chamber. Energizing the ignition wire may comprise activating a power supply and sending an electrical current of at least 60 amps through the ignition wire. In various embodiments, the ignition wire may be energized with at least 70 amps, at least 80 amps, at least 90 amps, or at least 100 amps. In various embodiments, the ignition wire may be energized for at least 1 second, or in some embodiments, at least 2 seconds, at least 3 second, at least 4 seconds, or at least 5 seconds.

After initiation, the aluminothermic reactions proceed very rapidly and may be complete within 10 minutes of initiation, or in some embodiments, within 5 minutes of initiation. However, the resulting reaction products comprising a slag phase and a tantalum alloy regulus may require 24 to 48 hours of cooling to reach ambient temperature. Once the reaction products reach an acceptable temperature, such as, for example, ambient temperature, the reaction chamber may be backfilled with air to remove the vacuum, the reaction chamber may be opened, and the reaction product removed from the reaction vessel. In various embodiments, the hot reaction products may be gas quenched by backfilling the reaction chamber with a gas, such as air or argon, for example, to accelerate cooling to ambient temperature. Backfilling with gas may be repeated multiple times to further accelerate cooling. However, gas quenching should only be performed, if at all, after the reaction products have solidified. Therefore, to ensure solidification, gas quenching should not be performed until at least 12 hours after initiation of the aluminothermic reactions.

As described above, the reaction products of the aluminothermic reactions comprise a solidified slag phase and a tantalum alloy or niobium alloy regulus. The slag phase may comprise oxides such as barium oxide and/or aluminum oxide, for example. The tantalum alloy or niobium alloy regulus may comprise alloying elements dissolved in a tantalum matrix or niobium matrix, wherein the alloying elements are produced from the precursor reactants (e.g., $Ta_2O_5$, $Nb_2O_5$, $MOo_3$, $TiO_2$, $ZrO_2$, $V_2O_5$, W, or $WO_3$), the sacrificial metal oxide reactants (e.g., $Fe_2O_3$ and/or CuO), and excess aluminum.

For example, Table 1 below shows a reactant mixture that may yield a 22.7-kilogram (50.0-pound) tantalum alloy regulus comprising 2.2 weight percent tungsten, sacrificial iron and copper, and excess aluminum.

TABLE 1

| Reactant | Formula | Amount (lbs) | Weight Percent |
|---|---|---|---|
| tantalum pentoxide | $Ta_2O_5$ | 65.6 | 56.10% |
| iron (III) oxide | $Fe_2O_3$ | 2.9 | 2.50% |
| copper (II) oxide | CuO | 2.6 | 2.20% |
| aluminum | Al | 18.4 | 15.70% |
| barium peroxide | $BaO_2$ | 26.3 | 22.50% |
| tungsten | W | 1.1 | 1.00% |

In various embodiments, the weight percentages shown in Table 1 may vary by ±10%, ±5%, ±2%, ±1%, ±0.5%, ±0.1%, ±0.05%, or 0.01%.

Additional target product weights may be obtained by scaling the relative amounts of the reactants and maintaining the relative weight percentages. The resulting tantalum alloy regulus comprising 2.2 weight percent tungsten may be electron beam melted to reduce the copper, aluminum, and iron content of the regulus material and produce a refined Ta-2.5W alloy ingot comprising 2.5 weight percent tungsten, balance tantalum and incidental impurities.

Alternative reactant mixture amounts for the aluminothermic production of niobium-containing tantalum-base alloy reguli, tantalum-containing niobium-base alloy reguli, tungsten-containing tantalum-base alloy reguli having different tungsten content, zirconium-containing niobium-base alloy reguli, titanium-containing niobium-base alloy reguli, molybdenum-containing tantalum-base alloy reguli, or other tantalum-base or niobium-base alloy compositions, including more highly alloyed compositions, may be determined in accordance with the information disclosed in this specification.

In various embodiments, a reactant mixture may comprise, based on total weight of the reactant mixture: 55.1% to 57.1% tantalum pentoxide powder; 0% to 3.5% iron (III) oxide powder; 0% to 3.2% copper (II) oxide powder; 21.5% to 23.5% barium peroxide powder; 14.7% to 16.7% aluminum metal powder; and 0% to 15% tungsten metal powder. In other embodiments, a reactant mixture may comprise, based on total weight of the reactant mixture: 55.6% to 56.6% tantalum pentoxide powder; 2.0% to 3.0% iron (III) oxide powder; 1.7% to 2.7% copper (II) oxide powder; 22.0% to 23.0% barium peroxide powder; 15.2% to 16.2% aluminum metal powder; and 0.5% to 1.5% tungsten metal powder. In some embodiments, a reactant mixture may comprise, based on total weight of the reactant mixture: 56.0% to 56.2% tantalum pentoxide powder; 2.4% to 2.6% iron (III) oxide powder; 2.1% to 2.3% copper (II) oxide powder; 22.4% to 22.6% barium peroxide powder; 15.6% to 15.8% aluminum metal powder; and 0.9% to 1.1% tungsten metal powder.

In various embodiments, the processes described in this specification may produce a tantalum alloy regulus having a tantalum yield of at least 80%, on a metal weight basis, of the initial tantalum provided by the tantalum pentoxide reactant, and in some embodiments, at least 85%, at least 90%, at least 93%, or at least 95%, on a metal weight basis, of the initial tantalum provided by the tantalum pentoxide reactant. In various embodiments, the processes described in this specification may produce a tantalum alloy regulus comprising at least 80 weight percent tantalum, and in some embodiments, at least 81%, at least 83%, at least 85%, at least 87%, or at least 89% tantalum, based on the total weight of the regulus. In various embodiments, the processes described in this specification may produce a tantalum alloy regulus comprising at least 1.0 weight percent tungsten, and in some embodiments, at least 1.3%, at least 1.5%, at least 1.7%, at least 2.0%, at least 2.1%, or at least 2.2% tungsten, based on the total weight of the regulus.

The aluminothermic processes described in this specification produce an oxide slag phase that may be completely separate from the metallic alloy regulus, which facilitates the separation and removal of the tantalum alloy or niobium alloy regulus from the slag. The tantalum alloy or niobium alloy reguli may be washed to remove residual slag and then directly input into an electron beam melting furnace to refine the alloy composition and produce a tantalum alloy or niobium alloy ingot. In this manner, the tantalum alloy or niobium alloy reguli produced in accordance with the processes described in this specification may function as pre-alloyed intermediates in the production of tantalum alloy or niobium alloy ingots and mill products. The tantalum alloy or niobium alloy reguli are monolithic, fully-consolidated, and non-brittle. The tantalum alloy or niobium alloy reguli also comprise alloying elements completely dissolved into the tantalum matrix for niobium matrix, which facilitates the direct electron beam melting and casting of tantalum alloy or niobium alloy ingots having uniform microstructure, specified alloy composition, and alloying elements completely and uniformly distributed in the tantalum matrix or niobium matrix.

Referring back to FIG. 1A, after electron beam melting the tantalum alloy or niobium alloy reguli produced in accordance with the processes described in this specification, the resulting tantalum alloy or niobium alloy ingots may be forged, rolled, cut, annealed, and cleaned to produce mill products such as tantalum alloy or niobium alloy billets, rods, bars, sheets, wires, and the like.

The non-limiting and non-exhaustive examples that follow are intended to further describe various non-limiting and non-exhaustive embodiments without restricting the scope of the embodiments described in this specification.

EXAMPLES

Example 1

A tantalum alloy regulus was produced by conducting an aluminothermic reaction using the reactant powders and amounts listed in Table 2.

TABLE 2

| Reactant | Formula | Amount (grams) | Weight Percent |
|---|---|---|---|
| tantalum pentoxide | $Ta_2O_5$ | 1800 | 56.16 |
| iron (III) oxide | $Fe_2O_3$ | 80 | 2.50 |
| copper (II) oxide | CuO | 70 | 2.18 |
| aluminum | Al | 505 | 15.76 |
| barium peroxide | $BaO_2$ | 720 | 22.46 |
| tungsten | W | 30 | 0.94 |
| total | — | 3205 | 100 |

The amount of aluminum metal powder was 4% excess of the stoichiometric amount needed for reduction of the tantalum pentoxide, iron (III) oxide, copper (II) oxide, and barium peroxide according to the following chemical equations:

$$3\ Ta_2O_5+10\ Al \rightarrow 6\ Ta+5\ Al_2O_3$$

$$W \rightarrow W$$

$$Fe_2O_3+2\ Al \rightarrow 2\ Fe+Al_2O_3$$

$$3\ CuO+2Al \rightarrow 3\ Cu+Al_2O_3$$

$$3\ BaO_2+2\ Al \rightarrow 3\ BaO+Al_2O_3$$

The reactant powders were thoroughly dry (<0.2% LOI) and finely divided (85% by weight −200 mesh). The reactant powders were individually weighed and loaded into a double cone powder blender. The reactant powders were mixed in the blender for at least 20 minutes to provide a macroscopically homogeneous reactant mixture. The reactant mixture was loaded into a reaction vessel.

The reaction vessel was cylindrically-shaped with an inside height of 12-inches and an inside diameter of 4.25-inches. The reaction vessel was fabricated from an iso-molded fine-grained graphite sheet forming the bottom of the reaction vessel, and an extruded medium-to-coarse-grained graphite sheet forming the cylindrical sidewalls. The bottom and sidewalls were approximately 1-inch thick. The reaction vessel was positioned on top of a layer of refractory bricks, and the layer of refractory bricks was positioned on top of a concrete slab. A layer heavy/dead-burned magnesium oxide powder was spread over the bottom interior surface of the reaction vessel and the reactant mixture was loaded on top of the magnesium oxide powder layer. The magnesium oxide powder layer formed a barrier between the reactant mixture and the graphite bottom surface of the reaction vessel.

A tantalum ignition wire was submerged into the reactant powder mixture in the reaction vessel. The ignition wire was connected to a power supply by aluminum wires. The aluminothermic reactions were initiated by sending an electrical current of 100 amps from the power supply through the ignition wire for five (5) seconds. The reactions proceeded very rapidly and the reaction products were allowed to cool to ambient temperature over a period of 48 hours. The reaction products comprised a well-defined and separated regulus and slag phase. The reaction products were removed from the reaction vessel and weighed to determine total material recovery. The total material recovery was determined to be 3145.6 grams (98% of the 3205 grams of initial reactant powders).

The regulus and slag phase were separated and analyzed for chemical composition. Based on the stoichiometry of the chemical reactions, and assuming a complete yield, the theoretical alloy composition of the regulus would be, in percentages by weight, 1.2% aluminum, 3.4% iron, 3.4% copper, 1.8% tungsten, balance tantalum (90.2%). Taking into account that copper is essentially immiscible in tungsten at ambient temperatures, the theoretical alloy composition is generally in agreement with measurements of the actual alloy composition of the regulus made using Scanning Electron Microscopy/Energy-Dispersive Spectroscopy (SEM/EDS) according to ASTM E1508-98(2008): Standard Guide for Quantitative Analysis by Energy-Dispersive Spectroscopy, which is incorporated by reference into this specification. The SEM/EDS analysis showed an actual alloy composition, in percentages by weight, of 3.4% aluminum, 8.4% iron, 2.0% tungsten, balance tantalum and incidental impurities. The tantalum yield in the regulus was 90% of the initial tantalum provided by the tantalum pentoxide reactant (on a metal weight basis). The slag phase comprised approximately 32% barium oxide and 68% aluminum oxide, on a mole basis, and small amounts of tantalum-containing, iron-containing, and copper-containing by-products.

Figure 7:
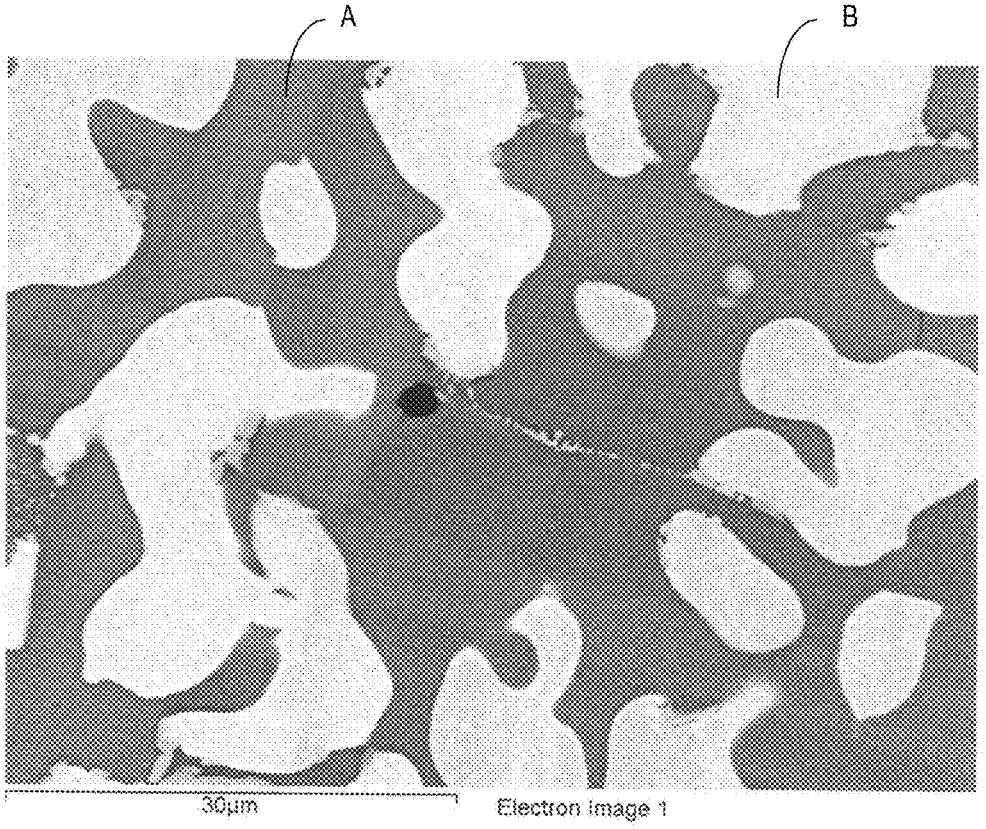
FIG. 7 is a scanning electron microscopy (SEM) image of the microstructure of a tantalum alloy regulus produced by aluminothermic reactions involving a tantalum pentoxide reactant.

FIG. 7 is an SEM image of the microstructure of the tantalum alloy regulus. The microstructure comprised two (2) observable phases: the darker phases labeled 'A', and the lighter phases labeled 'B', in FIG. 7. Based on SEM/EDS analysis, the A-phase is an aluminum- and iron-rich phase, and the B-phase is an aluminum- and iron-lean phase. Both phases (A and B) comprise tantalum as the predominant constituent and also comprise dissolved tungsten. The SEM/EDS analysis showed no phases comprising tungsten as the predominant constituent. Indeed, the SEM/EDS analysis showed that the tungsten concentration only varied from 0.4% to 3.7%, by weight, in each distinct phase, and that the average tungsten concentration was 2.0% over the entire SEM/EDS field. This indicated complete dissolution of the aluminothermically inert tungsten metal powder into the tantalum metal produced by the aluminothermic reduction of tantalum pentoxide.

The tantalum alloy regulus was monolithic, fully-consolidated, non-brittle, and lacked any cracking. The tantalum alloy regulus could be directly input into an electron beam melting furnace for refinement of the tantalum alloy composition, including reduction of the aluminum, copper, and iron to incidental impurity levels, homogeneous dissolution of the tungsten into the tantalum matrix, and establishment of a tungsten concentration within specification for Ta-2.5W.

Example 2

A tantalum alloy regulus was produced by conducting an aluminothermic reaction with the reactant powders and amounts listed in Table 3.

TABLE 3

| Reactant | Formula | Amount (grams) | Weight Percent |
|---|---|---|---|
| tantalum pentoxide | $Ta_2O_5$ | 1800 | 55.42 |
| iron (III) oxide | $Fe_2O_3$ | 160 | 4.93 |
| aluminum | Al | 518 | 15.95 |
| barium peroxide | $BaO_2$ | 740 | 22.78 |
| tungsten | W | 30 | 0.92 |
| total | — | 3248 | 100 |

The amount of aluminum metal powder was 4% excess of the stoichiometric amount needed for reduction of the tantalum pentoxide, iron (III) oxide, and barium peroxide according to the following chemical equations:

$$3\ Ta_2O_5+10\ Al \rightarrow 6\ Ta+5\ Al_2O_3$$

$$W \rightarrow W$$

$$Fe_2O_3+2\ Al \rightarrow 2\ Fe+Al_2O_3$$

$$3\ BaO_2+2\ Al \rightarrow 3\ BaO+Al_2O_3$$

The reactant powders were thoroughly dry (<0.2% LOI) and finely divided (85% by weight −200 mesh). The reactant powders were individually weighed and loaded into a double cone powder blender. The reactant powders were mixed in the blender for at least 20 minutes to provide a macroscopically homogeneous reactant mixture. The reactant mixture was loaded into a reaction vessel.

The reaction vessel was cylindrically-shaped with an inside height of 12-inches and an inside diameter of 4.25-inches. The reaction vessel was fabricated from an iso-molded fine-grained graphite sheet forming the bottom of the reaction vessel, and an extruded medium-to-coarse-grained graphite sheet forming the cylindrical sidewalls. The bottom and sidewalls were approximately 1-inch thick. The reaction vessel was positioned on top of a layer of refractory bricks, and the layer of refractory bricks was positioned on top of a concrete slab. A layer heavy/dead-burned magnesium oxide powder was spread over the bottom interior surface of the reaction vessel and the reactant mixture was loaded on top of the magnesium oxide powder layer. The magnesium oxide powder layer formed a barrier between the reactant mixture and the graphite bottom surface of the reaction vessel.

A tantalum ignition wire was submerged into the reactant powder mixture in the reaction vessel. The ignition wire was connected to a power supply by aluminum wires. The aluminothermic reactions were initiated by sending an electrical current of 100 amps from the power supply through the ignition wire for five (5) seconds. The reactions proceeded very rapidly and the reaction products were allowed to cool to ambient temperature over a period of 48 hours. The reaction products comprised a well-defined and separated regulus and slag phase. The reaction products were removed from the reaction vessel and weighed to determine total material recovery. The total material recovery was determined to be 3216.6 grams (99% of the 3248 grams of initial reactant powders).

The regulus and slag phase were separated and analyzed for chemical composition. Based on the stoichiometry of the chemical reactions, and assuming a complete yield, the theoretical alloy composition of the regulus would be, in percentages by weight, 1.2% aluminum, 6.8% iron, 1.8% tungsten, balance tantalum (90.2%). The slag phase comprised approximately 32% barium oxide and 68% aluminum oxide, on a mole basis, and small amounts of tantalum-containing and iron-containing by-products. The tantalum yield in the regulus was 88% of the initial tantalum provided by the tantalum pentoxide reactant (on a metal weight basis).

The tantalum alloy regulus was monolithic, fully-consolidated, and non-brittle. The tantalum alloy regulus could be directly input into an electron beam melting furnace for refinement of the tantalum alloy composition, including reduction of the aluminum and iron to incidental impurity levels, homogeneous dissolution of the tungsten into the tantalum matrix, and establishment of a tungsten concentration within specification for Ta-2.5W.

The processes and equipment for the production of tantalum alloys described in this specification provide operational and economic advantages over processes that use tantalum metal feed stocks. The processes described in this specification eliminate: (1) the need for relatively costly virgin sodium-reduced tantalum metal; (2) the costly HDH process; and (3) the pressing and sintering operations needed to produce a powder compact for electron beam melting. Referring to FIGS. 1A and 1B, the use of the less expensive tantalum pentoxide feedstock and the elimination of a number of unit operations results in a shorter and less expensive process flow for the production of tantalum alloy ingots and mill products. The processes described in this specification directly produce a monolithic, fully-consolidated, and non-brittle tantalum alloy regulus that may be readily isolated from a separate slag phase and directly input into an electron beam melting furnace for refinement of the tantalum alloy composition. The tantalum alloy reguli produced according to the processes described in this specification also comprise alloying elements completely dissolved into the tantalum matrix, which facilitates the direct electron beam melting and casting of tantalum alloy ingots having uniform microstructure, specified alloy composition, and alloying elements completely and uniformly distributed in the tantalum matrix.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the, scope of this specification. Thus, it is contemplated and understood that this specification supports additional embodiments not expressly set forth herein. Such embodiments may be obtained, for example, by combining, modifying, or reorganizing any of the disclosed steps, components, elements, features, aspects, characteristics, limitations, and the like, of the various non-limiting and non-exhaustive embodiments described in this specification. In this manner, Applicant reserves the right to amend the claims during prosecution to add features as variously described in this specification, and such amendments comply with the requirements of 35 U.S.C. § § 112(a) and 132(a).

What is claimed is:

1. A process for the production of a tantalum alloy comprising:

conducting aluminothermic reactions using a reactant mixture comprising:

tantalum pentoxide powder;

at least one of iron (III) oxide powder and copper (II) oxide powder;

barium peroxide powder; and aluminum metal powder.

2. The process of claim 1, wherein the reactant mixture further comprises at least one of niobium pentoxide powder, tungsten trioxide powder, molybdenum trioxide powder, chromium (III) oxide powder, hafnium dioxide powder, zirconium dioxide powder, titanium dioxide powder, vanadium pentoxide powder, and tungsten metal powder.

3. The process of claim 1, wherein the reactant mixture further comprises at least one of niobium pentoxide powder, tungsten trioxide powder, molybdenum trioxide powder, and tungsten metal powder.

4. The process of claim 1, wherein the reactant mixture further comprises niobium pentoxide powder.

5. The process of claim 1, wherein the reactant mixture further comprises tungsten trioxide powder and/or tungsten metal powder.

6. The process of claim 1, wherein the reactant mixture further comprises molybdenum trioxide powder.

7. The process of claim 1, wherein the aluminothermic reactions produce a tantalum alloy regulus and a separate slag phase.

8. The process of claim 7, further comprising electron beam melting the tantalum alloy regulus and producing a tantalum alloy ingot.

9. The process of claim 8, wherein the tantalum alloy ingot comprises:

at least one of niobium, tungsten, and molybdenum; and balance tantalum and incidental impurities.

10. The process of claim 1, wherein conducting the aluminothermic reactions comprises:

positioning the reactant mixture in a reaction vessel comprising a magnesium oxide layer located on a bottom surface of the reaction vessel; and initiating the aluminothermic reactions.

11. A process for the production of a tantalum alloy or a niobium alloy comprising:

conducting aluminothermic reactions using a reactant mixture comprising:

tantalum pentoxide powder and/or niobium pentoxide powder;

iron (III) oxide powder and/or copper (II) oxide powder;

barium peroxide powder;

aluminum metal powder; and at least one of tungsten trioxide powder, molybdenum trioxide powder, chromium (III) oxide powder, hafnium dioxide powder, zirconium dioxide powder, titanium dioxide powder, vanadium pentoxide powder, and tungsten metal powder.

12. The process of claim 11, wherein the reactant mixture comprises:

tantalum pentoxide powder;
molybdenum trioxide powder;
iron (III) oxide powder and/or copper (II) oxide powder;
barium peroxide powder; and
aluminum metal powder.

13. The process of claim 11, wherein the reactant mixture comprises:

niobium pentoxide powder;
iron (III) oxide powder and/or copper (II) oxide powder;
barium peroxide powder;
aluminum metal powder; and
at least one of tungsten trioxide powder, molybdenum trioxide powder, chromium (III) oxide powder, hafnium dioxide powder, zirconium dioxide powder, titanium dioxide powder, vanadium pentoxide powder, and tungsten metal powder.

14. The process of claim 13, wherein the reactant mixture comprises:

niobium pentoxide powder;
molybdenum trioxide powder;
iron (III) oxide powder and/or copper (II) oxide powder;
barium peroxide powder; and
aluminum metal powder.

15. The process of claim 13, wherein the reactant mixture comprises:

niobium pentoxide powder;
titanium dioxide powder;
iron (III) oxide powder and/or copper (II) oxide powder;
barium peroxide powder; and
aluminum metal powder.

16. The process of claim 13, wherein the reactant mixture comprises:

niobium pentoxide powder;
zirconium dioxide powder;
iron (III) oxide powder and/or copper (II) oxide powder;
barium peroxide powder; and
aluminum metal powder.

17. The process of claim 13, wherein the aluminothermic reactions produce a niobium alloy regulus and a separate slag phase.

18. The process of claim 17, further comprising electron beam melting the niobium alloy regulus and producing a niobium alloy ingot.

19. The process of claim 18, wherein the niobium alloy ingot comprises:

at least one of tungsten, molybdenum, hafnium, zirconium, titanium, and vanadium; and
balance niobium and incidental impurities.

20. The process of claim 18, wherein the niobium alloy ingot comprises:

at least one of molybdenum, zirconium, and titanium; and
balance niobium and incidental impurities.

21. A process for the production of a niobium alloy comprising:

conducting aluminothermic reactions using a reactant mixture comprising:
niobium pentoxide powder;
iron (III) oxide powder and/or copper (II) oxide powder;
barium peroxide powder;
aluminum metal powder; and
at least one of tantalum pentoxide powder, tungsten trioxide powder, molybdenum trioxide powder, chromium (III) oxide powder, hafnium dioxide powder, zirconium dioxide powder, titanium dioxide powder, vanadium pentoxide powder, and tungsten metal powder.

22. The process of claim 21, wherein the reactant mixture comprises:

niobium pentoxide powder;
tantalum pentoxide powder;
iron (III) oxide powder and/or copper (II) oxide powder;
barium peroxide powder; and
aluminum metal powder.

23. The process of claim 21, wherein the aluminothermic reactions produce a niobium alloy regulus and a separate slag phase, wherein the process further comprises electron beam melting the niobium alloy regulus and producing a niobium alloy ingot, and wherein the niobium alloy ingot comprises:

at least one of tantalum, molybdenum, zirconium, and titanium; and
balance niobium and incidental impurities.

* * * * *